US009261817B2

(12) United States Patent
Iwatsuki et al.

(10) Patent No.: US 9,261,817 B2
(45) **Date of Patent: *Feb. 16, 2016**

(54) REPLENISHING DEVELOPER HOUSING CONTAINER AND IMAGE FORMING APPARATUS

(71) Applicant: RICOH COMPANY, LTD., Tokyo (JP)

(72) Inventors: Hitoshi Iwatsuki, Shizuoka (JP); Shigenori Yaguchi, Shizuoka (JP); Hiroshi Tohmatsu, Shizuoka (JP); Toyoaki Tano, Shizuoka (JP); Hiroyuki Kishida, Shizuoka (JP); Kenichi Mashiko, Shizuoka (JP); Koichi Sakata, Shizuoka (JP); Hiroshi Hosokawa, Kanagawa (JP); Shunji Katoh, Kanagawa (JP); Shinji Tamaki, Tokyo (JP); Hiroshi Ikeguchi, Saitama (JP); Kenji Kikuchi, Kanagawa (JP); Michiharu Suzuki, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 14/279,595

(22) Filed: May 16, 2014

(65) Prior Publication Data

US 2014/0348552 A1 Nov. 27, 2014

(30) Foreign Application Priority Data

May 21, 2013 (JP) ..... 2013-107437

(51) Int. Cl.
*G03G 15/08* (2006.01)

(52) U.S. Cl.
CPC ..... *G03G 15/0877* (2013.01); *G03G 15/0839* (2013.01); *G03G 15/0872* (2013.01)

(58) Field of Classification Search
CPC ..... G03G 15/0839; G03G 15/0877
USPC ..... 399/260, 262
See application file for complete search history.

(56) References Cited

U.S. PATENT DOCUMENTS 5,495,323 A * 2/1996 Meetze, Jr. ..... 399/120
5,576,816 A * 11/1996 Staudt et al. ..... 399/262

(Continued)

FOREIGN PATENT DOCUMENTS

| | | |
|---|---|---|
| JP | 02-021591 | 5/1990 |
| JP | 2008-102394 | 1/2008 |
| WO | WO2013/077474 | 5/2013 |

OTHER PUBLICATIONS

U.S. Appl. No. 14/186,417, filed Feb. 21, 2014.

*Primary Examiner* — Benjamin Schmitt
(74) *Attorney, Agent, or Firm* — Cooper & Dunham LLP

(57) ABSTRACT

A replenishing developer housing container includes: a container body housing a replenishing developer; a conveying portion; a pipe receiving port; and an uplifting portion. The replenishing developer contains a toner and a carrier. The container body includes a protruding portion protruding from a container body interior side of the container opening portion toward one end of the container body and a curving portion curving so as to conform to the protruding portion. The uplifting portion includes an uplifting wall surface extending from an internal wall surface of the container body toward the protruding portion. When the replenishing developer housing container is mounted on the replenishing developer conveying device, the protruding portion is present between the curving portion and the replenishing developer receiving port of a conveying pipe being inserted.

20 Claims, 27 Drawing Sheets

(56) References Cited

U.S. PATENT DOCUMENTS

| | | | | |
|---|---|---|---|---|
| 6,169,864 | B1 * | 1/2001 | Baxendell et al. | 399/106 |
| 2008/0096121 | A1 | 4/2008 | Iwatsuki et al. | |
| 2008/0286668 | A1 * | 11/2008 | Ishigami et al. | 430/48 |
| 2012/0163877 | A1 | 6/2012 | Kikuchi et al. | |
| 2012/0195645 | A1 | 8/2012 | Takami et al. | |
| 2012/0213555 | A1 * | 8/2012 | Komatsu et al. | 399/262 |
| 2012/0219330 | A1 | 8/2012 | Kikuchi et al. | |
| 2012/0321341 | A1 | 12/2012 | Hori et al. | |
| 2013/0011166 | A1 | 1/2013 | Yamaguchi et al. | |
| 2013/0272750 | A1 | 10/2013 | Matsumoto et al. | |
| 2013/0330105 | A1 | 12/2013 | Komatsu et al. | |
| 2014/0348545 | A1 * | 11/2014 | Shiba et al. | 399/258 |
| 2014/0348546 | A1 * | 11/2014 | Kojima et al. | 399/258 |
| 2014/0348550 | A1 * | 11/2014 | Nagayama et al. | 399/262 |
| 2014/0348551 | A1 * | 11/2014 | Yamabe et al. | 399/263 |

* cited by examiner

REPLENISHING DEVELOPER HOUSING CONTAINER AND IMAGE FORMING APPARATUS

BACKGROUND OF THE INVENTION

1. Field of the Invention

The present invention relates to a replenishing developer housing container and an image forming apparatus.

2. Description of the Related Art

In an electrophotographic image forming apparatus such as a copier or a printer, a surface of an image bearing member uniformly charged is exposed to light to thereby form a latent image thereon; the latent image is developed to form a toner image; and then the toner image is transferred onto a transfer material such as a recording sheet. The transfer material on which the toner image is borne passes through a fixing device, where the toner is fixed on the transfer material under the application of heat or pressure.

In the image forming apparatus, examples of a developing device for developing the latent image on the image bearing member includes a one-component developing device by means of a toner containing a magnetic material and a two-component developing device by means of a developer composed of a toner and a carrier.

Among them, the two-component developing device is excellent in developability, so that it is used in most of currently used image forming apparatuses. Particularly in recent years, color image forming apparatuses for forming full-color or multi-color images have been frequently used, and keen demand has arisen for the two-component developing device.

In the image forming apparatus including the two-component developing device, the toner and the carrier are stirred in the developing device, and the toner is frictionally charged with the carrier and electrostatically adheres to an outer surface of the carrier. The carrier bearing the toner is conveyed to a developing area, where the toner is released from the carrier under the application of a developing bias and electrostatically adheres to the latent image on the image bearing member to thereby form a toner image. Therefore, in order to provide an image satisfying high durability and high stability by the two-component developing device, it is essential that the toner is stably charged with carrier during stirring. That is, it is essential that the carrier has a stable charge-imparting capacity even after use for a long period of time.

However, in the typical two-component developing device, the toner is consumed as a developing operation proceeds, whereas the carrier is not consumed and remains in a developing tank. Therefore, the carrier to be stirred with the toner in the developing tank deteriorates by a peeling of a coating resin from a surface of the carrier or an adherence of the toner to the surface of the carrier as the frequency at which they are stirred together is increased. Accordingly, resistivity of the carrier and chargeability of the developer are gradually decreased, so that developability of the developer excessively increases. As a result, various failures such as an increased image density and foggy images are induced.

In order to solve the problem, Japanese Patent Application Publication (JP-B) No. 02-21591 discloses a trickle developing device in which a carrier is gradually replaced by adding the carrier at the same timing as the toner which is consumed upon developing. Thus, a charge amount is prevented from varying and an image density is stabilized.

A replenishing developer composed of a toner and a carrier is replenished from a replenishing developer housing container as is the case with only a toner. For example, there is proposed a toner housing container that includes a rotatable tubular powder housing member, a conveying pipe receiving member fixed to the powder housing member, an opening provided in the conveying pipe receiving member, and an uplifting portion configured to uplift the toner upward in the container along with rotation of the container body (e.g., see JP-B No. 02-21591). According to this proposed technique, the toner is uplifted by the uplifting portion along with rotation of the container body, and the toner falls from the uplifting portion during the rotation and is supplied into the conveying pipe.

However, in the case of a system that employs the mechanism of uplifting the toner by the uplifting portion and supplying the toner into the conveying pipe, there has been a problem that a developing device is difficult to be replenished with the toner when only a small amount of the toner remains in a toner bottle.

Accordingly, it is currently requested to provide a toner housing container being capable of replenishing a developing device with a toner even when only a small amount of the toner remains in a toner housing container.

SUMMARY OF THE INVENTION

The present invention aims to solve the conventional problems described above, and achieve the following object. That is, an object of the present invention is to provide a replenishing developer housing container being capable of replenishing a developing device with a replenishing developer even when only a small amount of the replenishing developer remains in a replenishing developer housing container.

Means for solving the problems described above is as follows.

A replenishing developer housing container according to the present invention includes:

a container body mountable on a replenishing developer conveying device and housing a replenishing developer to be supplied to the replenishing developer conveying device;

a conveying portion provided in the container body and configured to convey the replenishing developer from one end of the container body in a longer direction thereof to the other end thereof at which a container opening portion is provided;

a pipe receiving port provided at the container opening portion and capable of receiving a conveying pipe fixed to the replenishing developer conveying device; and an uplifting portion configured to uplift the replenishing developer conveyed by the conveying portion from a lower side of the container body to an upper side thereof and move the replenishing developer into a replenishing developer receiving port of the conveying pipe, wherein the replenishing developer contains a toner and a carrier, wherein the container body includes a protruding portion protruding from a container body interior side of the container opening portion toward the one end, wherein the uplifting portion includes an uplifting wall surface extending from an internal wall surface of the container body toward the protruding portion, and a curving portion curving so as to conform to the protruding portion, wherein the protruding portion is provided such that when the replenishing developer housing container is mounted on the replenishing developer conveying device, the protruding portion is present between the curving portion and the replenishing developer receiving port of the conveying pipe being inserted.

The present invention can provide a replenishing developer housing container that can solve the conventional problems described above and that can replenish a developing device with a replenishing developer even when only a small amount of the replenishing developer remains in a replenishing developer housing container.

Figure 1:
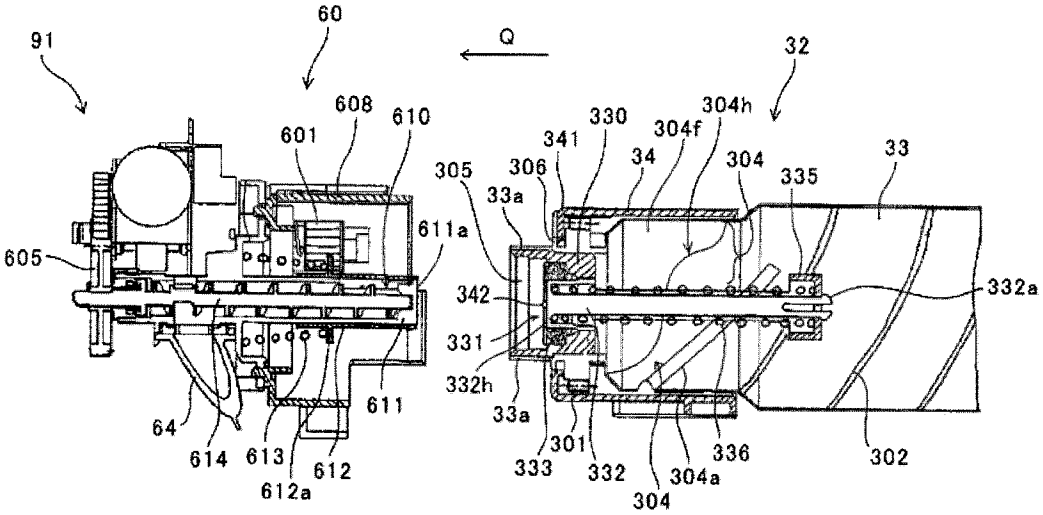
FIG. 1 is a cross-sectional explanatory diagram of a replenishing developer conveying device before mounted with a replenishing developer housing container according to an example of the present invention and of the replenishing developer housing container.

DETAILED DESCRIPTION OF THE INVENTION (Replenishing developer Housing Container)

A first replenishing developer housing container of the present invention includes at least a replenishing developer, a container body, a conveying portion, a pipe receiving port, and an uplifting portion, and further includes other members according to necessity.

The replenishing developer is used for image formation. The replenishing developer contains a toner and a carrier.

The container body is mountable on a replenishing developer conveying device, and houses the replenishing developer to be supplied to the replenishing developer conveying device.

The conveying portion is provided in the container body, and conveys the replenishing developer from one end of the container body in a longer direction thereof to the other end thereof at which a container opening portion is provided.

The pipe receiving port is provided at the container opening portion, and is capable of receiving a conveying pipe fixed to the replenishing developer conveying device.

The uplifting portion (also referred to as replenishing developer delivering unit) uplifts the replenishing developer conveyed by the conveying portion from a lower side of the container body to the upper side thereof and moves the replenishing developer to a replenishing developer receiving port of the conveying pipe.

The container body includes a protruding portion protruding from a container body interior side of the container opening portion to the one end.

The uplifting portion includes an uplifting wall surface extending from an internal wall surface of the container body toward the protruding portion, and a curving portion curving so as to conform to the protruding portion.

The protruding portion is provided such that when the replenishing developer housing container is mounted on the replenishing developer conveying device, the protruding portion is present between the curving portion and the replenishing developer receiving port of the conveying pipe being inserted.

The protruding portion is preferably a plate-shaped member and provided such that a flat side surface of the plate-shaped member is present between the curving portion and the replenishing developer receiving port of the replenishing developer conveying pipe being inserted. This makes it easier for the flat side surface of the plate-shaped member to receive the replenishing developer, and facilitates passing of the replenishing developer from the uplifting portion into the replenishing developer conveying pipe.

The flat side surface is a side surface intersecting approximately perpendicularly with such a surface of the plate-shaped member as facing the uplifting portion.

The uplifting portion includes a rising portion rising from an internal wall surface of the container body toward the protruding portion. The rising portion includes a curving portion curving so as to conform to the protruding portion.

The protruding portion is provided such that when the replenishing developer housing container is mounted on the replenishing developer conveying device, the protruding portion is present between the curving portion and the replenishing developer receiving port of the conveying pipe being inserted.

It is preferable that the replenishing developer housing container include two uplifting portions, and that when the replenishing developer housing container is mounted on the replenishing developer conveying device, the protruding portion be present between the curving portions of the respective ones of the two uplifting portions and the replenishing developer receiving port of the conveying pipe being inserted. This leads to efficient uplifting of the replenishing developer, and facilitates passing of the replenishing developer from the uplifting portions into the replenishing developer conveying pipe.

Two protruding portions may or may not be provided to face each other by sandwiching therebetween a longer direction center axis of the replenishing developer housing container.

(Image Forming Apparatus)

In an image forming apparatus of the present invention, the replenishing developer housing container is demountably set in the body of the image forming apparatus.

Figure 2:
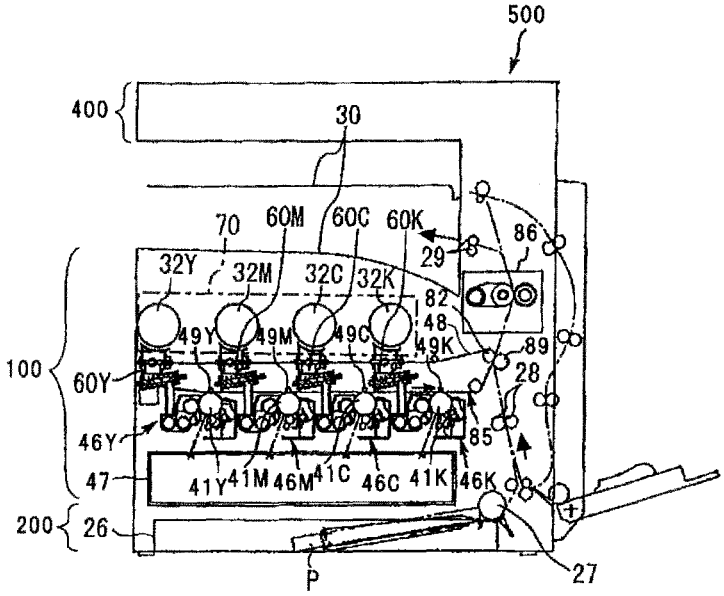
FIG. 2 is a schematic configuration diagram showing an example image forming apparatus of the present invention.

An embodiment of the present invention will be explained below with reference to the drawings. FIG. 2 explains one embodiment of the present invention applied to a copier (hereinafter referred to as copier 500) as the image forming apparatus.

FIG. 2 is a schematic configuration diagram of the copier 500 of the present embodiment. The copier 500 includes a copier body (hereinafter referred to as printer section 100), a sheet feeding table (hereinafter referred to as sheet feeding section 200), and a scanner (hereinafter referred to as scanner section 400) mounted on the printer section 100.

Four replenishing developer housing containers 32 (Y, M, C, and K) corresponding to respective colors (yellow, magenta, cyan, and black) are demountably (replaceably) set in a replenishing developer housing container accommodating section 70 provided in an upper portion of the printer section 100. An intermediate transfer unit 85 is provided below the replenishing developer housing container accommodating section 70.

The intermediate transfer unit 85 includes an intermediate transfer belt 48 as an intermediate transfer member, four first transfer bias rollers 49 (Y, M, C, and K), a second transfer backup roller 82, a plurality of tension rollers, an unillustrated intermediate transfer cleaning device, and the like. The intermediate transfer belt 48 is tensed and supported by a plurality of roller members, and endlessly moves in the arrow direction of FIG. 2 by being rotatably driven by the second transfer backup roller 82, which is one of the plurality of roller members.

In the printer section 100, four image forming units 46 (Y, M, C, and K) corresponding to the respective colors are provided side by side so as to face the intermediate transfer belt 48. Four replenishing developer replenishing devices 60 (Y, M, C, and K) as replenishing developer conveying devices corresponding to the replenishing developer housing containers of the respective colors are provided below the four replenishing developer housing containers 32 (Y, M, C, and K). Replenishing developers, which are powder developers housed in the replenishing developer housing containers 32 (Y, M, C, and K), are supplied (replenished) by corresponding ones of the replenishing developer replenishing devices 60

(Y, M, C, and K) into developing devices of the image forming units 46 (Y, M, C, and K) corresponding to the respective colors.

As shown in FIG. 2, the printer section 100 includes an exposing device 47 as a latent image forming unit below the four image forming units 46. The exposing device 47 scans the surface of photoconductors 41 (Y, M, C, and K) by exposing the surface to light based on image information of a document image captured with the scanner section 400, and forms an electrostatic latent image on the surface of the respective photoconductors. Image information may be image information not captured through the scanner section 400 but input from an external device such as a personal computer connected to the copier 500.

In the present embodiment, a laser beam scanner system using a laser diode is employed as the exposing device 47. However, other systems such as one using a LED array may be used as an exposing unit.

Figure 3:
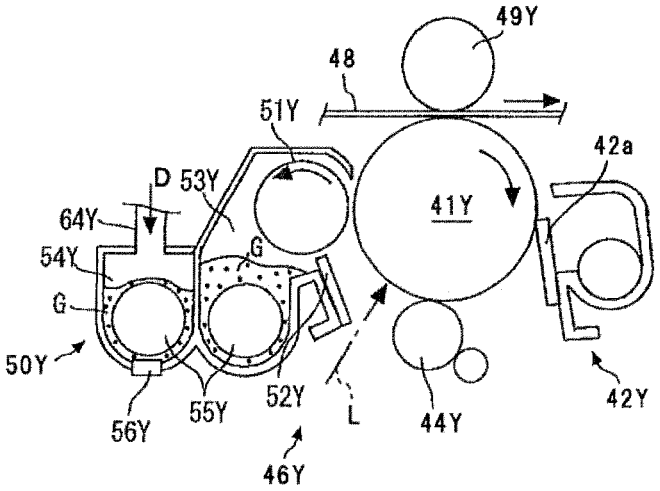
FIG. 3 is an exemplary diagram showing one configuration of an image forming unit of the image forming apparatus shown in FIG. 2.

FIG. 3 is an exemplary diagram showing one configuration of the image forming unit 46Y corresponding to yellow.

The image forming unit 46Y includes a drum-shaped photoconductor 41Y as an image bearing member. The image forming unit 46Y is configured such that a charging roller 44Y as a charging unit, a developing device 50Y as a developing unit, a photoconductor cleaning device 42Y, an unillustrated charge eliminating device, and the like are provided around the photoconductor 41Y. Through an image forming process (a charging step, an exposing step, a developing step, a transfer step, and a cleaning step) performed on the photoconductor 41Y, a yellow toner image is formed on the photoconductor 41Y.

The other three image forming units 46 (M, C, and K) have substantially the same configuration as the image forming unit 46Y corresponding to yellow, except for using different colors of toners. Toner images corresponding to the respective colors of toners are formed on the photoconductors 41 (M, C, and K). In the following, the image forming unit 46Y corresponding to yellow will only be explained, by appropriately skipping explanation of the other three image forming units 46 (M, C, and K).

The photoconductor 41Y is driven to rotate in the clockwise direction of FIG. 3 by an unillustrated driving motor. With respect to the photoconductor 41Y, the surface of the photoconductor 41Y is electrically charged uniformly at a position facing the charging roller 44Y (charging step). After this, the surface of the photoconductor 41Y reaches a position at which it is irradiated with laser light L emitted by the exposing device 47, and has an electrostatic latent image corresponding to yellow formed thereon by being scanned and exposed at this position (exposing step). After this, the surface of the photoconductor 41 reaches a position at which it faces the developing device 50Y, and has the electrostatic latent image developed with the yellow toner at this position and a yellow toner image formed thereon (developing step).

Each of the four first transfer bias rollers 49 (Y, M, C, and K) of the intermediate transfer unit 85 forms a first transfer nip by sandwiching the intermediate transfer belt 48 between itself and the photoconductor 41 (Y, M, C, and K). A transfer bias inverse to the polarity of the toner is applied to the first transfer bias rollers 49 (Y, M, C, and K).

The surface of the photoconductor 41Y on which a toner image is formed through the developing step reaches the first transfer nip facing the first transfer bias roller 49Y across the intermediate transfer belt 48, and has the toner image on the photoconductor 41Y transferred onto the intermediate transfer belt 48 by this first transfer nip (first transfer step). At this time, although slightly, the toner remains un-transferred on the photoconductor 41Y. The surface of the photoconductor 41Y having transferred the toner image onto the intermediate transfer belt 48 by the first transfer nip reaches a position facing the photoconductor cleaning device 42Y. The un-transferred toner remained on the photoconductor 41Y is mechanically collected by a cleaning blade 42*a* of the photoconductor cleaning device 42Y at this facing position (cleaning step). Finally, the surface of the photoconductor 41Y reaches a position facing the unillustrated charge eliminating device, and has a residual potential on the photoconductor 41Y eliminated at this position. In this way, the series of image forming process performed on the photoconductor 41Y is completed.

Such an image forming process is performed in the other image forming units 46 (M, C, and K) in the same manner as in the yellow image forming unit 46Y. That is, the exposing device 47 provided below the image forming unite 46 (M, C, and K) emits laser light L based on image information to the photoconductors 41 (M, C, and K) of the image 10*o* forming units 46 (M, C, and K). Specifically, the exposing device 47 emits laser light L from a light source, and irradiates the photoconductors 41 (M, C, and K) with the laser light through a plurality of optical elements while scanning the laser light L with a polygon mirror being driven to rotate. After this, toner images of the respective colors formed on the photoconductors 41 (M, C, and K) through the developing step are transferred onto the intermediate transfer belt 48.

At this time, the intermediate transfer belt 48 passes through the first transfer nips of the respective first transfer bias rollers 49 (Y, M, C, and K) sequentially by running in the arrow direction of FIG. 2. Through this, the toner images of the respective colors on the photoconductors 41 (Y, M, C, and K) are first-transferred onto the intermediate transfer belt 48 and overlaid, and thereby a color toner image is formed on the intermediate transfer belt 48.

The intermediate transfer belt 48 on which the color toner image is formed with the toner images of the respective colors transferred and overlaid reaches a position facing the second transfer roller 89. At this position, the second transfer backup roller 82 forms a second transfer nip by sandwiching the intermediate transfer belt 48 between itself and the second transfer roller 89. Then, the color toner image formed on the intermediate transfer belt 48 is transferred by the effect of for example, a transfer bias applied to the second transfer backup roller 82 onto a recording medium P such as a transfer sheet conveyed to the position of the second transfer nip. At this time, un-transferred toner that has not been transferred onto the recording medium P remains on the intermediate transfer belt 48. The intermediate transfer belt 48 having passed through the second transfer nip reaches the position of the unillustrated intermediate transfer cleaning device, and has the un-transferred toner on the surface thereof collected. In this way, the series of transfer process performed on the intermediate transfer belt 48 is completed.

Next, the behavior of the recording medium P will be explained.

The recording medium P conveyed to the second transfer nip described above is transferred thereto via a sheet feeding roller 27, a registration roller pair 28, etc., from a sheet feeding tray 26 provided in the sheet feeding section 200 provided below the printer section 100. Specifically, a plurality of sheets of recording media P are overlaid and stocked in the sheet feeding tray 26. When the sheet feeding roller 27 is driven to rotate in the counterclockwise direction in FIG. 2, the topmost recording medium P is conveyed to a roller nip formed by the two rollers of the registration roller pair 28.

The recording medium P conveyed to the registration roller pair 28 stops once at the position of the roller nip of the registration roller pair 28 stopped from being driven to rotate. Then, by the registration roller pair 28 being started to rotate so as to be in time for the color toner image on the intermediate transfer belt 48 to arrive at the second transfer nip, the recording medium P is conveyed to the second transfer nip. In this way, a desired color toner image is transferred onto the recording medium P.

The recording medium P onto which the color toner image is transferred at the second transfer nip is conveyed to the position of a fixing device 86. Through the fixing device 86, the color toner image transferred onto the surface is fixed on the recording medium P with heat and pressure applied by a fixing belt and a pressurizing roller. The recording medium P passed through the fixing device 86 is discharged to the outside of the apparatus through the gap between the rollers of a sheet discharging roller pair 29. The recording medium P discharged to the outside of the apparatus by the sheet discharging roller pair 29 is stacked sequentially on a stacking section 30 as an output image. In this way, the series of image forming process in the copier 500 is completed.

Next, the configuration and operation of the developing device 50 in the image forming unit 46 will be explained in greater detail. The explanation will be given by taking the image forming unit 46Y corresponding to yellow for example. However, the image forming units 46 (M, C, and K) corresponding to the other colors have also the same configuration and operation.

As shown in FIG. 3, the developing device 50Y includes a developing roller 51Y as a developer bearing member, a doctor blade 52Y as a developer regulating plate, two developer conveying screws 55Y, a toner concentration detecting sensor 56Y, etc. The developing roller 51Y faces the photoconductor 41Y, and the doctor blade 52Y faces the developing roller 51Y. The two developer conveying screws 55Y are provided in two developer receptacles (53Y and 54Y). The developing roller 51Y is constituted by a magnet roller fixed thereinside, a sleeve rotating along the circumference of the magnet roller, etc. The first developer receptacle 53Y and the second developer receptacle 54Y contain a two-component developer G composed of a carrier and a toner. The second developer receptacle 54Y communicates with a toner fall-down conveying path 64Y through an opening formed at the top thereof. The toner concentration detecting sensor 56Y detects the toner concentration in the developer G in the second developer receptacle 54Y.

The developer G in the developing device 50Y circulates to and from the first developer receptacle 53Y and the second developer receptacle 54Y while being stirred by the two developer conveying screws 55Y. The developer G in the first developer receptacle 53Y is conveyed by one of the developer conveying screws 55Y, and supplied onto and borne by the surface of the sleeve of the developing roller 51Y by the effect of a magnetic field formed by the magnet roller in the developing roller 51Y. The sleeve of the developing roller 51Y is driven to rotate in the counterclockwise direction as indicated by an arrow in FIG. 3, and the developer G borne on the developing roller 51Y moves over the developing roller 51Y along with the rotation of the sleeve. At this time, the toner the developer G is frictioned with the carrier in the developer G to be electrically charged to a potential of an opposite polarity to the carrier and electrostatically adsorbed to the carrier, to be thereby borne on the developing roller 51Y together with the carrier attracted to the magnetic field formed on the developing roller 51Y.

The developer G borne on the developing roller 51Y is conveyed in the arrow direction of FIG. 3 and reaches a doctor region at which the doctor blade 52Y and the developing roller 51Y face each other. When the developer G on the developing roller 51Y passes the doctor region, the amount of the developer is regulated and optimized. After this, the developer G is conveyed to a developing region, which is a position at which the developer faces the photoconductor 41Y. In the developing region, the toner in the developer G is adsorbed to a latent image that is formed on the photoconductor 41Y by a developing electric field formed between the developing roller 51Y and the photoconductor 41Y. The developer G remained on the surface of the developing roller 51Y passed through the developing region reaches above the first developer receptacle 53Y along with the rotation of the sleeve, and is detached from the developing roller 51Y at this position.

The toner concentration of the developer G in the developing device 50Y is adjusted to a certain range. Specifically, the replenishing developer housed in a replenishing developer housing container 32Y is replenished into the second developer receptacle 54Y through the replenishing developer replenishing device 60Y according to the amount of consumption of the toner contained in the developer G in the developing device 50Y along with development. The replenishing developer replenished into the second developer receptacle 54Y is mixed and stirred with the developer G by the two developer conveying screws 55Y, and circulates to and from the first developer receptacle 53Y and the second developer receptacle 54Y.

Next, a configuration around the developing device will be described.

A developer replenishing device configured to replenish the developing device with a developer (replenishing developer) composed of a fresh toner and carrier is provided above the developing device. A developer discharging device configured to discharge an excessive developer in the developing device is provided below the developing device.

(Replenishing Developer)

A replenishing developer of the present invention contains at least a toner and a carrier. The toner contained in the replenishing developer which is housed in a developer housing container may be the below-described toner. The carrier will be described below in detail, but may be a magnetic carrier in which a core material is coated with a coating layer including predetermined particles.

(Developer in Developing Device)

A toner contained in the developer in a developing device may be the same as or different from the toner housed in the developer housing container. A carrier may also be the same as or different from the carrier housed in the developer housing container.

A carrier used in the present embodiment will be described below in detail.

Next, a developing operation of the developing device including the developer replenishing device and the developer discharging device will be described.

Firstly, the developer in a developing device which has already housed in a developer receptacle is stirred and sufficiently mixed with a conveying screw to thereby be frictionally charged. Thereafter, the developer in a developing device is supplied to a developing roller and adhered onto a surface of the sleeve thereof in layers.

The developer adhered onto the developing roller in layers is regulated to a predetermined thickness by a layer thickness regulating member to thereby be formed into a uniform layer. Thereafter, the uniform layer is conveyed to a developing region D at which the developer faces the photoconductor along with the rotation of the sleeve. At this developing region D, a toner contained in a two-component developer is electrostatically adsorbed onto a latent image formed on the photoconductor according to a document image on an image forming apparatus body side. Thus, a developing is performed to form a toner image on the photoconductor.

The toner image formed on the photoconductor is transferred onto a recording sheet on the image forming apparatus body side, and fixed on the recording sheet at a fixing portion.

As the developing operation is repeated, the toner contained in the developer in a developing device housed in the developer receptacle is consumed to be gradually decreased. When the toner concentration detecting sensor detects a decreased amount of the toner, a developer replenisher in the developer replenishing device is driven. This allows the replenishing developer containing a carrier and a toner described below in detail which is housed inside a developer housing member of the developer housing container to be replenished via a conveying tube. A fresh two-component developer replenished into the developer receptacle is stirred with the conveying screw in the developer receptacle, to thereby sufficiently mix with the developer in a developing device which has been housed before replenishing.

The developer receptacle is replenished with the carrier at a predetermined percentage together with the toner through replenishing of the replenishing developer from the developer replenishing device. Therefore, an amount of the developer is gradually excessive in the developer receptacle. An excessive two-component developer in the developer receptacle spills over a regulated height in the receptacle, and is corrected to a container through a discharging pipe of the developer discharging device.

Next, the replenishing developer replenishing device 60 (Y, M, C, and K) will be explained.

Figure 4:
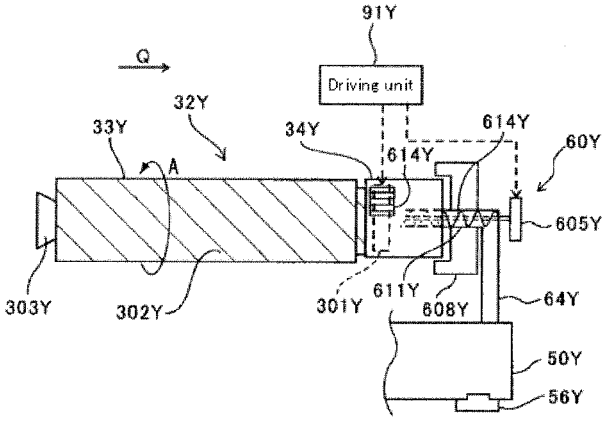
FIG. 4 is an exemplary diagram showing a state that a replenishing developer housing container is set in a replenishing developer replenishing device of the image forming apparatus shown in FIG. 2.
Figure 5:
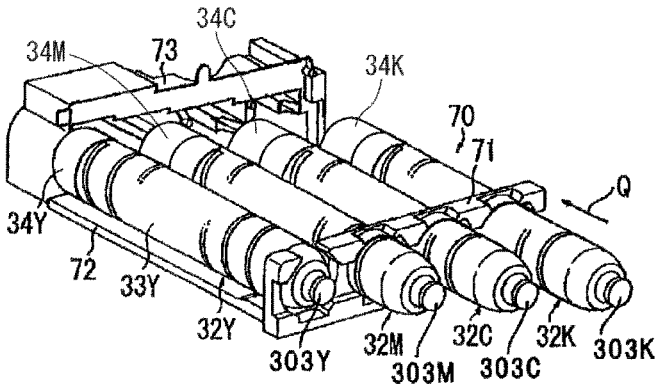
FIG. 5 is a schematic perspective diagram showing an example state that a replenishing developer housing container is set in a replenishing developer replenishing device.

FIG. 4 is an exemplary diagram showing a state that the replenishing developer housing container 32Y is mounted on the replenishing developer replenishing device 60Y. FIG. 5 is a schematic perspective diagram showing a state that four replenishing developer housing containers 32 (Y, M, C, and K) are mounted in the replenishing developer housing container accommodating section 70.

The replenishing developers in the replenishing developer housing containers 32 (Y, M, C, and K) mounted in the replenishing developer housing container accommodating section 70 of the printer section 100 are appropriately replenished into the developing devices 50 (Y, M, C, and K) according to the consumption of the toners in the developing devices 50 (Y, M, C, and K) for the respective colors, as shown in FIG. 4. At this time, the replenishing developers in the replenishing developer housing containers 32 (Y, M, C, and K) are replenished by the corresponding replenishing developer replenishing devices 60 (Y, M, C, and K) provided per toner color. The four replenishing developer replenishing devices 60 (Y, M, C, and K) and four replenishing developer housing containers 32 (Y, M, C, and K) have substantially the same configuration, except for using toners of different colors for the image forming process. Therefore, in the following, explanation will be given only on the replenishing developer replenishing device 60Y and replenishing developer housing container 32Y corresponding to yellow, and explanation on the replenishing developer replenishing devices 60 (M, C, and K) and replenishing developer housing containers 32 (M, C, and K) corresponding to the other three colors will be skipped appropriately.

The replenishing developer replenishing device 60Y (Y, M, C, and K) is constituted by the replenishing developer housing container accommodating section 70, a conveying nozzle 611 (Y, M, C, and K) as a conveying pipe, a conveying screw 614 (Y, M, C, and K) as a conveying member, a replenishing developer fall-down conveying path 64 (Y, M, C, and K), a container rotation driving unit 91 (Y, M, C, and K), etc.

For the expediency of explanation, a later-described container opening portion 33*a* side of a container body 33 is defined as a container leading end side, and the side opposite to the container opening portion 33*a* (i.e., a later-described gripping portion 303 side) is defined as a container rear end side, based on the direction in which the replenishing developer housing container 32Y is mounted onto the replenishing developer replenishing device 60Y. When the replenishing developer housing container 32Y is moved in the direction of an arrow Q in FIG. 4 and mounted in the replenishing developer housing container accommodating section 70 of the printer section 100, in conjunction with this mounting motion, the conveying nozzle 611Y of the replenishing developer replenishing device 60Y is inserted into the replenishing developer housing container 32Y through the container leading end side thereof. As a result, the interior of the replenishing developer housing container 32Y and the interior of the conveying nozzle 611Y come into communication with each other. The mechanism of this establishment of communication in conjunction with the mounting motion will be described later in detail.

As for the form of the replenishing developer housing container, the replenishing developer housing container 32Y is an approximately cylindrical replenishing developer bottle. The replenishing developer housing container 32Y is mainly constituted by a container leading end side cover 34Y held non-rotatably on the replenishing developer housing container accommodating section 70, and a container body 33Y as a replenishing developer housing member with which a container gear 301Y is formed integrally. The container body 33Y is held rotatably relative to the container leading end side cover 34Y.

As shown in FIG. 5, the replenishing developer housing container accommodating section 70 is mainly constituted by a container cover receiving section 73, a container receiving section 72, and an insertion port forming section 71. The container cover receiving section 73 is a section in which the container leading end side cover 34Y of the replenishing developer housing container 32Y is held. The container receiving section 72 is a section on which the container body 33Y of the replenishing developer housing container 32Y is supported. The insertion port forming section 71 is a section that constitutes an insertion port for an operation of mounting the replenishing developer housing container 32Y onto the container receiving section 72. When an unillustrated body cover provided at the front side (i.e., a front side in the direction perpendicular to the sheet in which FIG. 2 is drawn) of the copier 500 is opened, the insertion port forming section 71 of the replenishing developer housing container accommodating section 70 appears. Then, while keeping the longer direction of the replenishing developer housing containers 32 (Y, M, C, and K) extending in the horizontal direction, an operation of mounting or demounting the replenishing developer housing containers 32 (Y, M, C, and K) (i.e., a mounting/demounting operation oriented in the longer direction of the replenishing developer housing containers 32 as a mounting/demounting direction) is performed from the front side of the copier 500. A set cover 608Y in FIG. 4 is part of the container cover receiving section 73 of the replenishing developer housing container accommodating section 70.

The container receiving section 72 is formed such that the length thereof in the longer direction is substantially the same as the length of the container body 33Y in the longer direction. The container cover receiving section 73 is provided at the container leading end side of the container receiving section 72 in the longer direction (mounting/demounting direction) thereof and the insertion port forming section 71 is provided at one end side of the container receiving section 72 in the longer direction thereof. In FIG. 5, grooves, of which longer direction extends in the axial direction of the container bodies 33, are formed immediately below the four replenishing developer housing containers 32 so as to extend from the insertion port forming section 71 to the container cover receiving section 73. A pair of slide guides 361 (FIG. 7) are provided at the lower portion of the container leading end side cover 34 on both sides of the container leading end side cover, in order to allow the container body to fit with the groove and make a sliding move. The groove of the container receiving section 72 is provided with a pair of slide rails that protrude from both sides thereof. So as to sandwich the pair of slide rails from above and below respectively, slide grooves 361*a* are formed in the slide guides 361 in parallel with the axis of rotation of the container body 33. The container leading end side cover 34 includes a container locking portion 339 that engages with a replenishing device side locking member provided on the set cover 608 upon mounting on the replenishing developer replenishing device 60.

Hence, along with the operation of mounting the replenishing developer housing container 32Y, the container leading end side cover 34Y slides over the container receiving section 72 for a while after passing through the insertion port forming section 71, and after this, gets mounted on the container cover receiving section 73.

Figure 6:
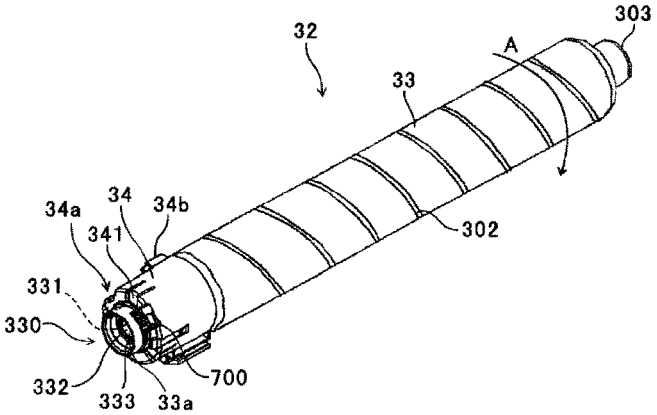
FIG. 6 is a perspective explanatory diagram showing an example configuration of a replenishing developer housing container of the present invention.

As shown in FIG. 6, the container leading end side cover 34 is provided with an ID tag (ID chip) 700 in which usage context of the replenishing developer housing container 32 and such data are recorded. The container leading end side cover 34 is also provided with a color-incompatible rib 34*b* that prevents a replenishing developer housing container 32 housing a toner of a given color from being mounted on the set cover 608 for a different color. The posture of the container leading end side cover 34 on the replenishing device 60 is determined when the slide guides 361 engage with the slide rails of the container receiving section 72 in the mounting operation. This allows the container locking portion 339 to be positionally aligned with the replenishing device side locking member 609 smoothly and the ID tag 700 to be positionally aligned with a connector on the apparatus body smoothly. The ID tag is an electronic substrate provided with a memory element for storing information of the replenishing developer housing container (the color of the toner housed, how many times the container is used, etc.), and is not limited to as described in the present embodiment. The system may not include the ID tag.

Figure 8:
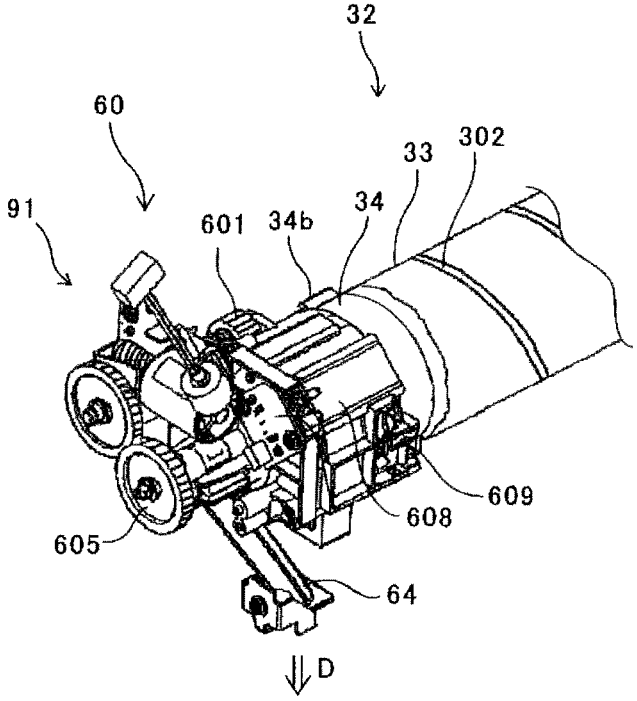
FIG. 8 is a perspective explanatory diagram of an example of a replenishing developer conveying device mounted with a replenishing developer housing container and the replenishing developer housing container.

In the state that the container leading end side cover 34Y is mounted on the container cover receiving section 73, rotation driving is input to the container gear 301Y (FIG. 10) provided on the container body 33Y from the container rotation driving unit 91Y constituted by a driving motor, a driving gear, etc. through a container driving gear 601Y as shown in FIG. 8. As a result, the container body 33Y is driven to rotate in the direction of the arrow A in FIG. 4. The rotation of the container body 33Y causes rotation of also a spiral projection 302Y (rotary conveying portion) formed in a spiral form on the internal circumferential surface of the container body 33Y, to thereby convey the replenishing developer housed in the container body 33Y along the longer direction of the container body from one end (i.e. the gripping portion 303 side) located at the left-hand side of FIG. 4 to the other end (i.e., the container opening portion 33*a* side) located at the right-hand side. As a result, the replenishing developer is supplied into the conveying nozzle 611Y from the container leading end side cover 34Y provided at the other end 33. In other words, the rotation of the spiral projection 302Y causes the replenishing developer to be supplied into the conveying nozzle 611Y inserted into a nozzle receiving port 331Y.

A conveying screw 614Y is provided in the conveying nozzle 611Y. The conveying screw 614Y rotates upon input of rotation driving into a conveying screw gear 605Y from the container rotation driving unit 91Y, and conveys the replenishing developer supplied into the conveying nozzle 611Y. The conveying direction downstream end of the conveying nozzle 611Y is connected to the replenishing developer fall-down conveying path 64Y. The replenishing developer conveyed by the conveying screw 614Y falls through the replenishing developer fall-down conveying path 64Y by its own weight and is replenished into the developing device 50Y (the second developer receptacle 54Y).

When the replenishing developer housing containers 32 (Y, M, C, and K) have expired (i.e., when the containers have become empty with almost all of the housed replenishing developer consumed), they are replaced with new ones respectively. The replenishing developer housing container 32 is provided with the gripping portion 303 at a longer-direction one end thereof that is opposite to the container leading end side cover 34. For the replacement, the replacement personnel can remove the mounted replenishing developer housing container 32 by gripping the gripping portion 303 and withdrawing the container.

The replenishing developer replenishing device 60Y controls the amount of replenishing developer to be supplied into the developing device 50Y based on the rotation speed of the conveying screw 614Y. Hence, the replenishing developer having passed through the conveying nozzle 611Y is directly conveyed into the developing device 50Y through the replenishing developer fall-down conveying path 64Y with the amount of supply into the developing device 50Y uncontrolled. Even the replenishing developer replenishing device 60Y, of which conveying nozzle 611Y is inserted into the replenishing developer housing container 32Y as in the present embodiment, may be provided with a first replenishing developer reservoir such as a replenishing developer hopper.

The replenishing developer replenishing device 60Y of the present embodiment is configured to convey the replenishing developer supplied into the conveying nozzle 611Y by the conveying screw 614Y. However, the conveying member for conveying the replenishing developer supplied into the conveying nozzle 611Y is not limited to a screw member. For example, a mechanism for imparting a conveying force by means of a member other than a screw member may also be employed, such as a mechanism for generating a negative pressure at the opening of the conveying nozzle 611Y by means of a well-known powder pump.

Next, the replenishing developer housing containers 32 (Y, M, C, and K) and the replenishing developer replenishing devices 60 (Y, M, C, and K) of the present embodiment will be explained in greater detail. As described above, the replenishing developer housing containers 32 (Y, M, C, and K) and the replenishing developer replenishing devices 60 (Y, M, C, and K) have substantially the same configuration, except for using different colors of toners. Hence, the following explanation will be given by omitting the suffixes Y, M, C, and K representing the colors of the toners.

Figure 7:
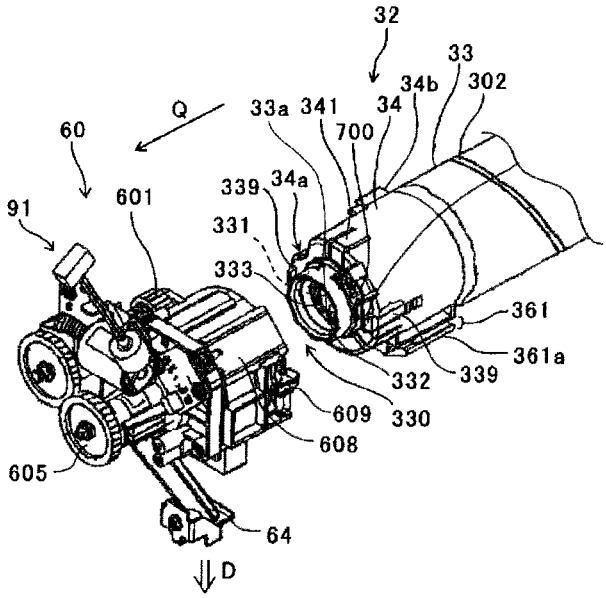
FIG. 7 is a perspective explanatory diagram of an example of a replenishing developer conveying device before mounted with a replenishing developer housing container and the replenishing developer housing container.

FIG. 6 is a perspective diagram explaining the replenishing developer housing container 32. FIG. 7 is a perspective diagram explaining the replenishing developer replenishing device 60 before mounted with the replenishing developer housing container 32 and the leading end of the replenishing developer housing container 32. FIG. 8 is a perspective diagram explaining the replenishing developer replenishing device 60 mounted with the replenishing developer housing container 32, and the container leading end of the replenishing developer housing container 32.

Figure 9:
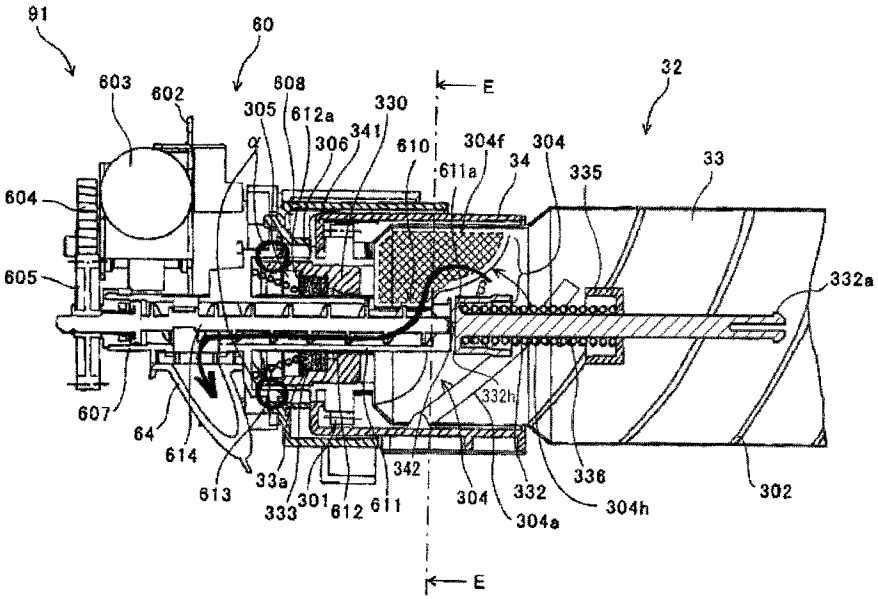
FIG. 9 is a cross-sectional explanatory diagram of an example of a replenishing developer conveying device mounted with a replenishing developer housing container and the replenishing developer housing container.

FIG. 1 is a cross-sectional diagram explaining the replenishing developer replenishing device 60 before mounted with the replenishing developer housing container 32 and the container leading end of the replenishing developer housing container 32. FIG. 9 is a cross-sectional diagram explaining the replenishing developer replenishing device 60 mounted with the replenishing developer housing container 32 and the container leading end of the replenishing developer housing container 32.

The replenishing developer replenishing device 60 includes the conveying nozzle 611 in which the conveying screw 614 is provided, and a nozzle shutter 612. The nozzle shutter 612 closes a nozzle opening 610 formed in the conveying nozzle 611 while in a non-mounted state (the state of FIG. 1 and FIG. 7) before mounted with the replenishing developer housing container 32, and opens the nozzle opening 610 while in a mounted state (the state of FIG. 8 and FIG. 9) after mounted with the replenishing developer housing container 32. On the other hand, a nozzle receiving port 331 as a pipe insertion port into which the conveying nozzle 611 is inserted while in the mounted state is formed in the center of the leading end surface of the replenishing developer housing container 32, and there is provided a container shutter 332 as an opening/closing member for closing the nozzle receiving port 331 while in the non-mounted state.

First, the replenishing developer housing container 32 will be explained.

Figure 10:
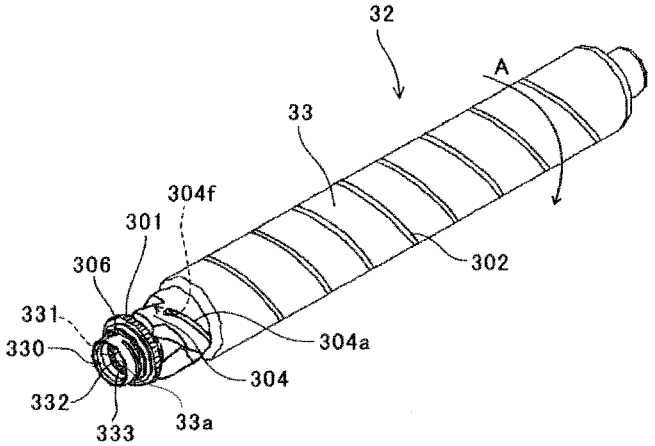
FIG. 10 is a perspective explanatory diagram of an example replenishing developer housing container in a state that a cover at the leading end is removed.

As described above, the replenishing developer housing container 32 is mainly constituted by the container body 33 and the container leading end side cover 34. FIG. 10 is a perspective diagram explaining a state of the replenishing developer housing container 32 from which the container leading end side cover 34 is removed from the state of FIG. 6. Note that the replenishing developer housing container 32 of the present invention is not limited to one that is mainly constituted by the container body 33 and the container leading end side cover 34. For example, when omitting the functions of the container leading end side cover 34 such as the slide guides 361 and the ID tag 700, the replenishing developer housing container may be used in the state of FIG. 10 in which there is no container leading end side cover 34. Further, the replenishing developer housing container can be free from the container leading end side cover by having such functions as the slide guides 361 and the ID tag 700 on the replenishing developer housing container.

Figure 11:
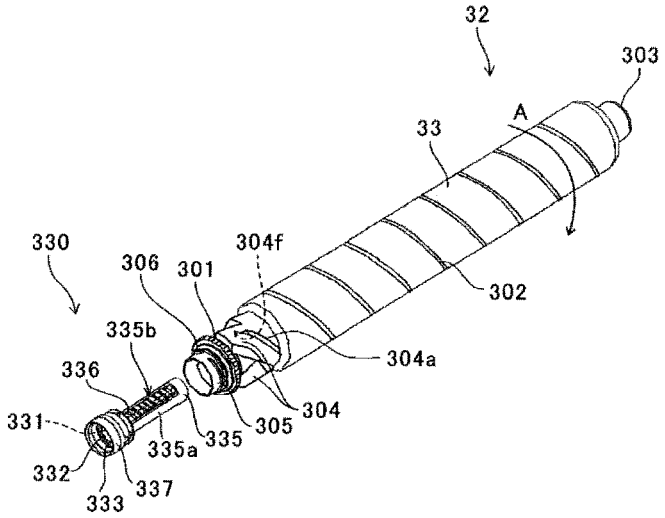
FIG. 11 is a perspective explanatory diagram of an example replenishing developer housing container in a state that a nozzle receiving member is removed from a container body.
Figure 12:
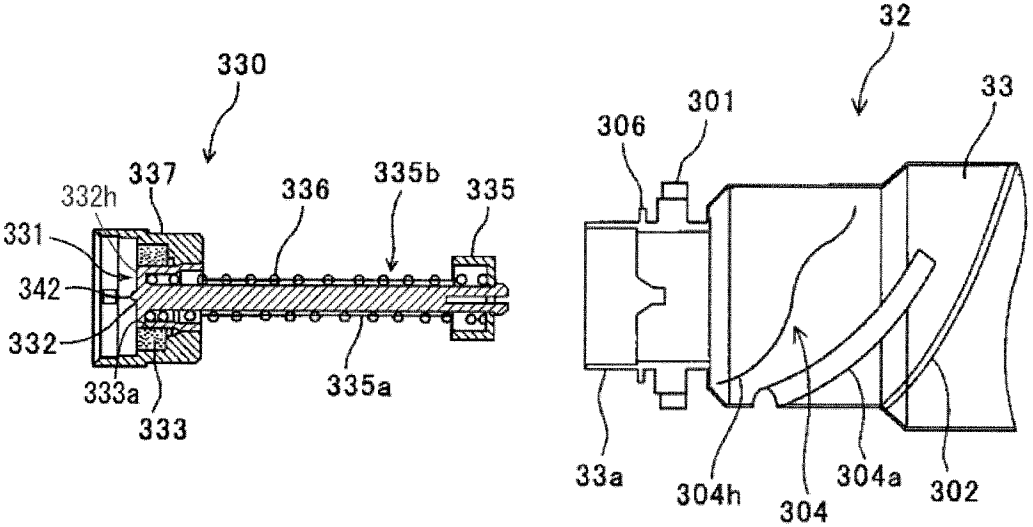
FIG. 12 is a cross-sectional explanatory diagram of an example replenishing developer housing container in a state that a nozzle receiving member is removed from a container body.
Figure 13:
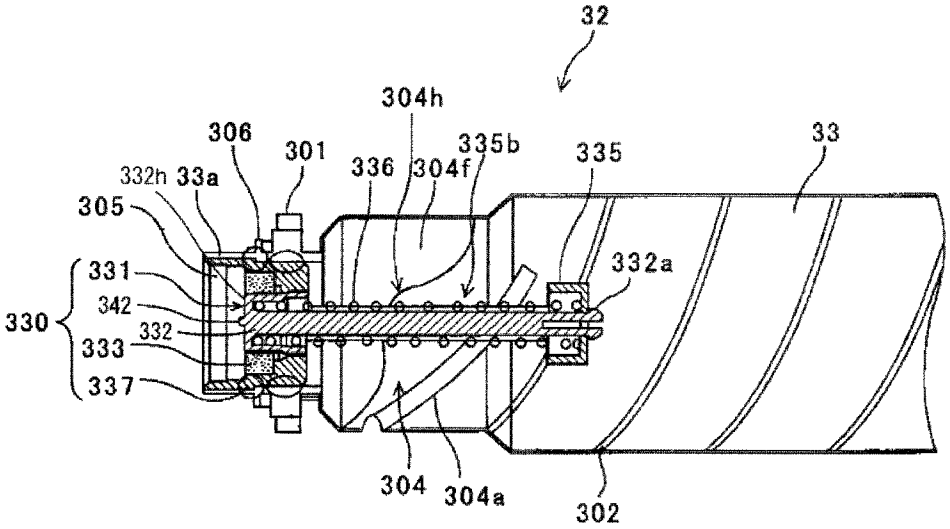
FIG. 13 is a cross-sectional explanatory diagram of an example replenishing developer housing container in a state that the nozzle receiving member is mounted on the container body from the state of FIG. 12.

FIG. 11 is a perspective diagram explaining a state of the replenishing developer housing container 32 from which a nozzle receiving member 330 as a pipe insertion member is removed from the container body 33 from the state of FIG. 10. FIG. 12 is a cross-sectional diagram explaining the state of the replenishing developer housing container 32 from which the nozzle receiving member 330 is removed from the container body 33. FIG. 13 is a cross-sectional diagram explaining a state of the replenishing developer housing container 32 mounted with the nozzle receiving member 330 on the container body 33 from the state of FIG. 12 (a state of the replenishing developer housing container 32 from which the container leading end side cover 34 is removed as in FIG. 10).

As shown in FIG. 10 and FIG. 11, the container body 33 is approximately cylindrical, and configured to rotate about the center axis of the cylinder as the rotation axis. Hereinafter, a direction parallel with this rotation axis will be referred to as "rotation axis direction", and a side in the rotation axis direction at which the nozzle receiving port 331 of the replenishing developer housing container 32 is formed (i.e., a side at which the container leading end side cover 34 is provided) will be referred to as "container leading end side". A side at which the gripping portion 303 of the replenishing developer housing container 32 is provided (i.e., a side opposite to the container leading end side) will be referred to as "container rear end side". The aforementioned longer direction of the replenishing developer housing container 32 is the rotation axis direction. When the replenishing developer housing container 32 is mounted on the replenishing developer replenishing device 60, the rotation axis direction is a horizontal direction. A portion of the container body 33 that is on the container rear end side from the container gear 301 has an external diameter greater than the container leading end side, and the spiral projection 302 is formed on the internal circumferential surface of this portion. When the container body 33 rotates in the direction of the arrow A in the drawing, a conveying force to move from the rotation axis direction one end side (the container rear end side) to the other end side (the container leading end side) is imparted to the replenishing developer in the container body 33 by the effect of the spiral projection 302. That is, the spiral projection as a conveying portion is provided inside the container body.

Figure 32:
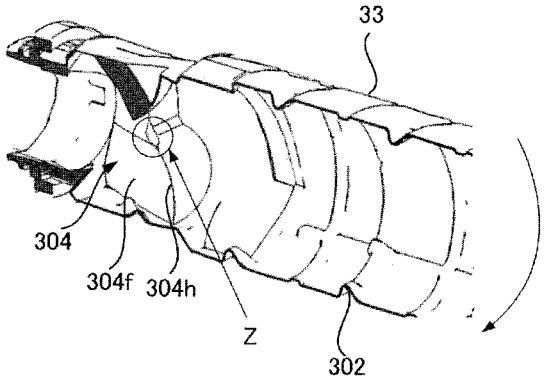
FIG. 32 is a perspective cross-sectional diagram showing a configuration of a replenishing developer housing container of the present invention.

An uplifting portion 304 is formed on the internal wall of the container body 33 at the container leading end side. When the replenishing developer is conveyed to the container leading end side by the spiral projection 302 along with rotation of the container body 33 in the direction of the arrow A of FIG. 10 and FIG. 11, the uplifting portion uplifts the conveyed replenishing developer upward by means of the rotation of the container body 33. The uplifting portion 304 is constituted by bosses **304*h* and uplifting wall surfaces 304*f* as shown in FIG. 13 and FIG. 32**.

The boss **304*h* is a portion (rising portion) that rises inward in the container body 33 toward the center of rotation of the container body 33 while forming a spiral like a ridge line of a mountain. The uplifting wall surface 304*f* is a wall surface that connects the boss 304*h* with the internal circumferential wall of the container body 33 and that is on the container-rotation-direction downstream side of the boss 304*h***.

When the replenishing developer comes into an internal space facing the uplifting portion 304 by the conveying force of the spiral projection 302 while the uplifting wall surface **304*f* is located at the lower side, the uplifting wall surface 304*f* uplifts the replenishing developer upward along with rotation of the container body 33. This enables the replenishing developer to be uplifted above the inserted conveying nozzle 611**. That is, the replenishing developer is uplifted from the lower side to the upper side.

When the rotation advances further, the replenishing developer uplifted by the uplifting wall surface 611 slips off from the uplifting wall surface due to the gravity force, or collapses and falls down.

The conveying nozzle 611, which is a later-described conveying pipe on the apparatus body, is present at where the replenishing developer slips off to. Therefore, the replenishing developer is moved into a nozzle opening of the conveying pipe.

Figure 30:
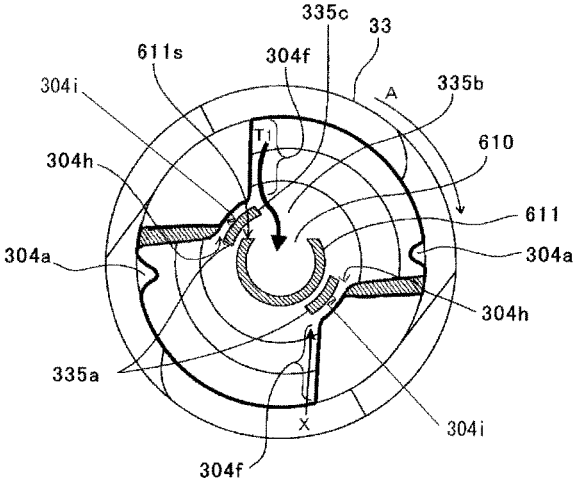
FIG. 30 is a cross-sectional diagram of FIG. 9 taken along a line E-E.

FIG. 30 is a cross-sectional diagram taken along a line E-E of FIG. 9. As shown in FIG. 30, a boss **304*h* is shaped like a gentle mountain as influenced by the container body 33** being formed by blow molding.

In FIG. 9, etc., a boss **304*h* is expressed with a curve for the convenience of distinguishing the uplifting portion 304. An uplifting wall surface 304*f* is a region expressed with grating as in FIG. 9, and so as to be in a point symmetry with respect to the rotation axis of the container body 33 as shown in FIG. 30, there are a pair of inclined surfaces constituting uplifting wall surfaces connecting the bosses 304***h* with the internal circumferential surface of the container body 33. The boss 304*h* is provided so as to protrude from the container internal wall surface from which it rises toward the opposite internal wall surface facing this internal wall surface, and so as to extend continuously in the direction toward the opening portion. In the region represented by the cross-section taken along the line E-E of FIG. 9, an internal wall surface on the container-rotation-direction upstream side of the boss 304*h* appears as a thick wall as in FIG. 30, since the direction along the line E-E for sectioning FIG. 9 to obtain the cross-section and the extending direction of this internal wall surface are roughly the same. The boss 304*h* is located at this seemingly thick portion.

Figure 33:
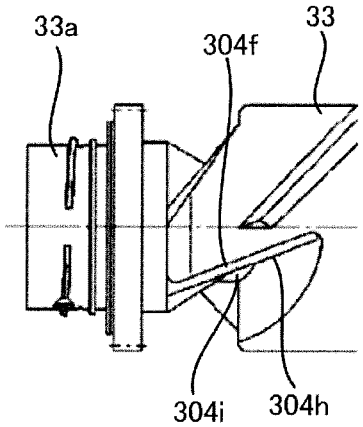
FIG. 33 is a side elevation showing a configuration of a replenishing developer housing container of the present invention.

Because of a further necessity of conveying the replenishing developer in the direction toward the container opening portion 33*a*, the uplifting wall surface 304*f* is inclined so as to be farther from the longer direction axial line (i.e., the dashed-dotted line in FIG. 33) of the container body 33 as the uplifting wall surface extends more from the boss 304*h* toward the container opening portion 33*a* as shown in FIG. 33. With this configuration, when the uplifting wall surface uplifts the replenishing developer by rotating, the uplifting wall surface inclines toward the opening portion (i.e., a direction extending from the boss to the opening portion becomes not horizontal but oblique downward; to elaborate, the uplifting wall surface inclines outward in the radial direction of the container from the longer-direction axial line). This makes it easier for the replenishing developer to be conveyed in the direction toward the container opening portion.

The container gear 301 is formed at a more container leading end side of the container body 33 than the uplifting portion 304. The container leading end side cover 34 is provided with a gear exposing opening 34*a* from which a portion (at a deeper side of FIG. 6) of the container gear 301 is exposed when the container leading end side cover is mounted on the container body 33. When the replenishing developer housing container 32 is mounted on the replenishing developer replenishing device 60, the container gear 301 exposed from the gear exposing opening 34*a* engages with the container driving gear 601 of the replenishing developer replenishing device 60.

The container opening portion 33*a* having a cylindrical shape is formed at a more container leading end side of the container body 33 than the container gear 301. By press-fitting a receiving member fixing portion 337 of the nozzle receiving member 330 into the container opening portion 33*a*, it is possible to fix the nozzle receiving member 330 into the container body 33. The method for fixing the nozzle receiving member 330 is not limited to press fitting, but may be fixing with an adhesive and fixing by screwing.

The replenishing developer housing container 32 is configured such that a replenishing developer is filled into the container body 33 thereof from the opening of the container opening portion 33*a*, and after this, the nozzle receiving member 330 is fixed into the container opening portion 33*a* of the container body 33.

A cover claw hooking portion 306 is formed at the container gear 301 side end of the container opening portion 33*a* of the container body 33. The container leading end side cover 34 is mounted on the replenishing developer housing container 32 (container body 33) being in the state shown in FIG. 10, from the container leading end side (the lower-left side of FIG. 10). As a result, the container body 33 extends through the container leading end side cover 34 in the rotation axis direction, and a cover claw 341 provided on the top portion of the container leading end side cover 34 is hooked in the cover claw hooking portion 306. The cover claw hooking portion 306 is formed so as to extend round the external circumferential surface of the container opening portion 33*a*. By the cover claw 341 being hooked, the container body 33 and the container leading end side cover 34 can be mounted on each other rotatably relative to each other.

The container body 33 is formed by biaxial stretching blow molding process. This biaxial stretching blow molding process is typically a two-stage process including a pre-form molding step and a stretching blow molding step. In the pre-form molding step, a resin is injection-molded into a pre-form having a test tube shape. By this injection molding, the container opening portion 33*a*, the cover claw hooking portion 306, and the container gear 301 are formed at the mouth portion of the test tube shape. In the stretching blow molding step, the pre-form that has been cooled after the pre-form molding step and released from the molding die is heated and softened, and after this, blow-molded and stretched.

The portions of the container body 33 that are on the container rear end side of the container gear 301 are molded in the stretching blow molding step. That is, the uplifting portion 304, the portion where the spiral projection 302 is formed, and the gripping portion 303 are molded in the stretching blow molding step.

The portions of the container body 33 that are on the container leading end side of the container gear 301, such as the container gear 301, the container opening portion 33*a*, the cover claw hooking portion 306, etc. remain as their shapes on the pre-form obtained by the injection molding, which ensures them a molding precision. On the other hand, the uplifting portion 304, the portion where the spiral projection 302 is formed, and the gripping portion 303 are stretched and molded in the stretching blow molding step after injection-molded, which results in a poorer molding precision than the portions obtained by the pre-form molding.

Next, the nozzle receiving member 330 fixed into the container body 33 will be explained.

Figure 14:
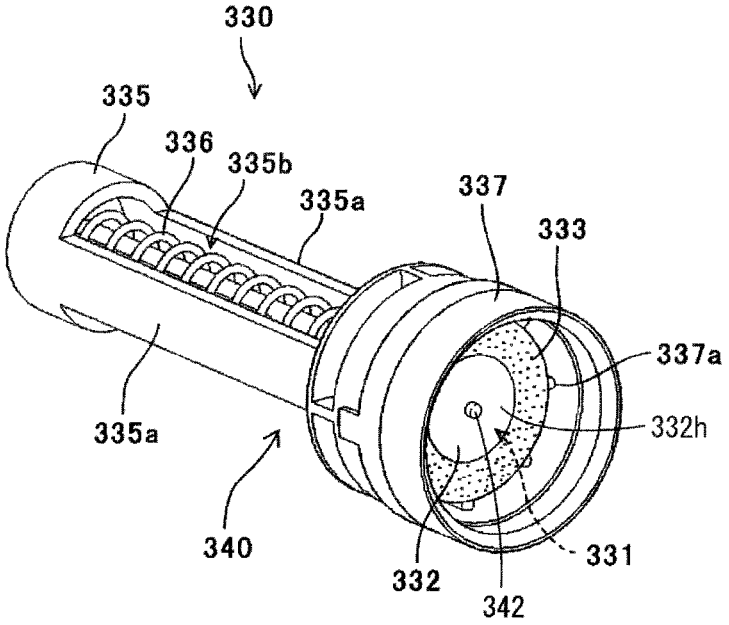
FIG. 14 is a perspective explanatory diagram of an example nozzle receiving member seen from a container leading end side.
Figure 15:
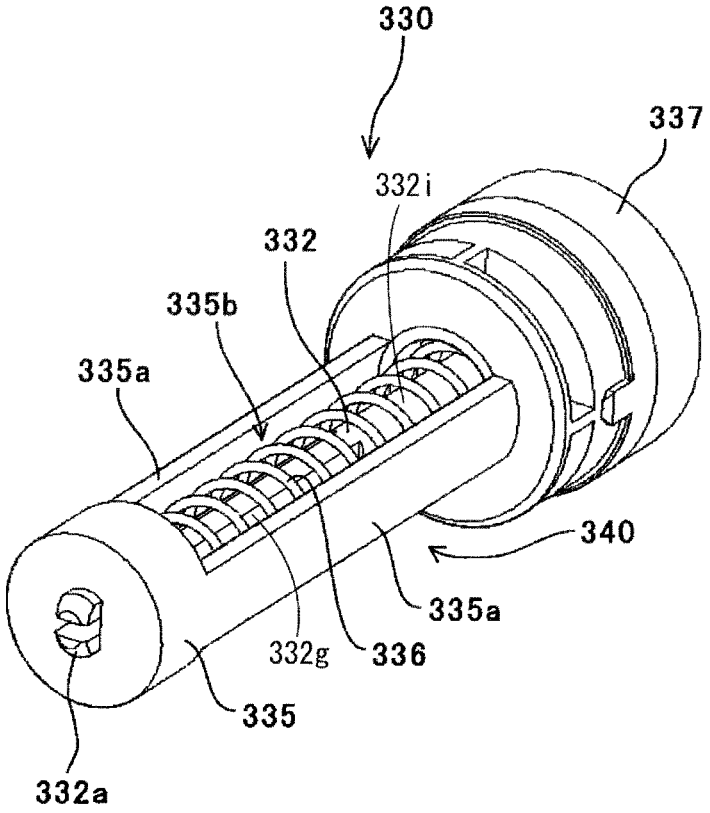
FIG. 15 is a perspective explanatory diagram of an example nozzle receiving member seen from a container rear end side.
Figure 16:
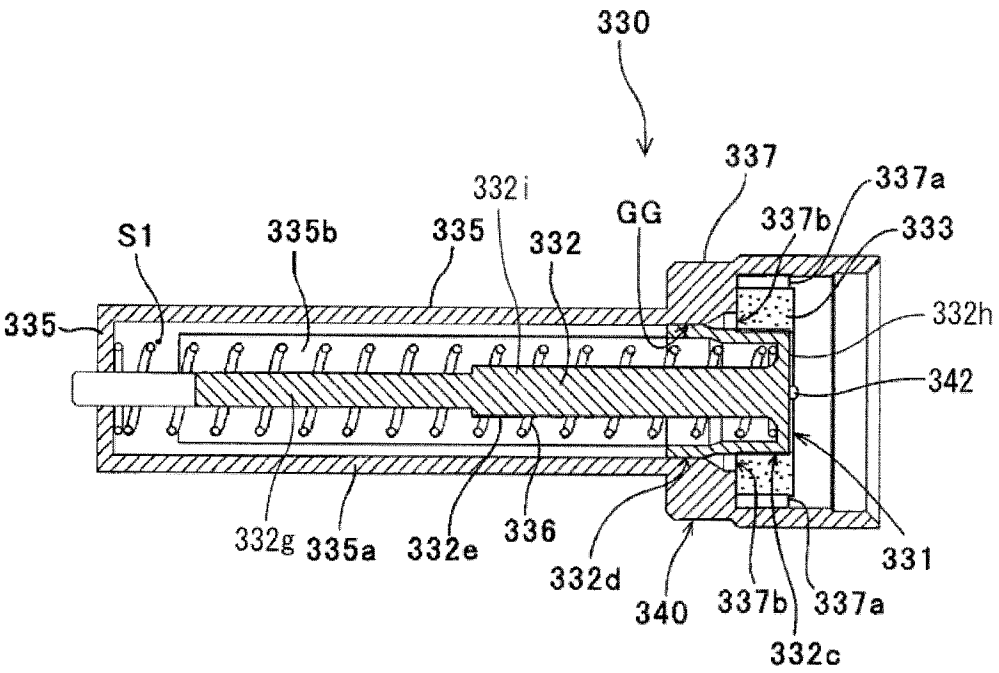
FIG. 16 is a cross-sectional diagram of an example nozzle receiving member in the state shown in FIG. 13.
Figure 17:
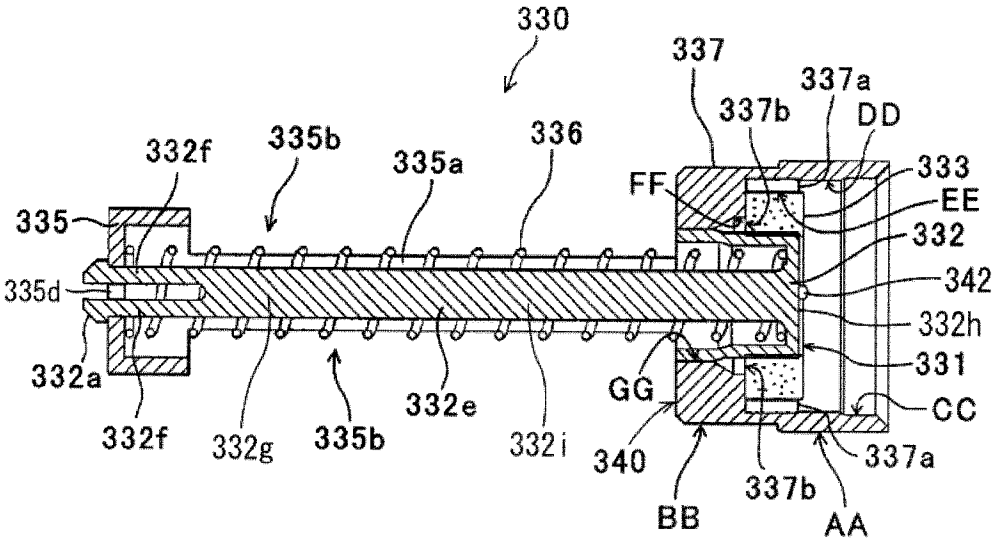
FIG. 17 is a cross-sectional diagram of an example nozzle receiving member in the state shown in FIG. 13.
Figure 18:
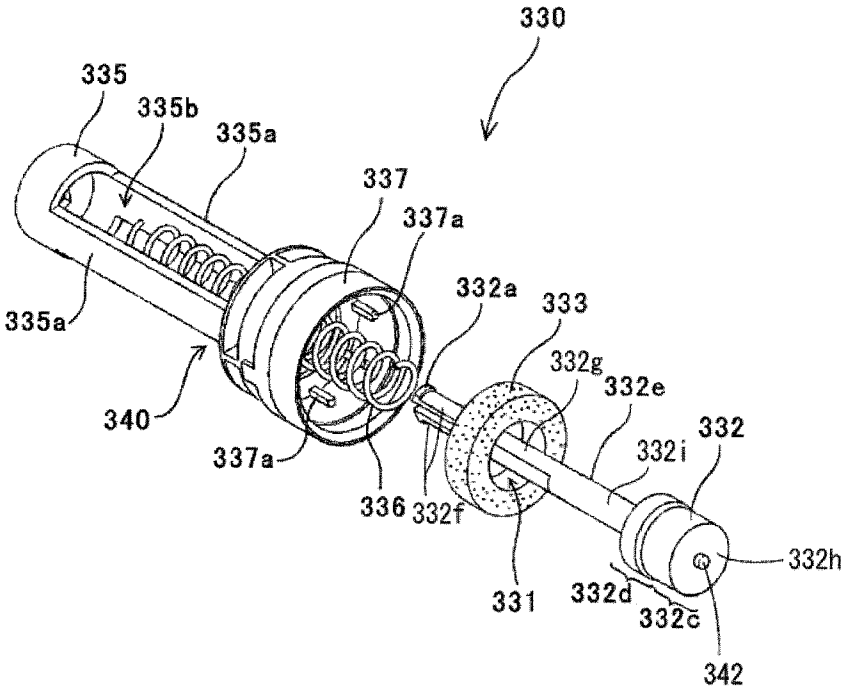
FIG. 18 is an exploded perspective diagram of an example nozzle receiving member.

FIG. 14 is a perspective diagram explaining the nozzle receiving member 330 seen from the container leading end side. FIG. 15 is a perspective diagram explaining the nozzle receiving member 330 seen from the container rear end side. FIG. 16 is a top cross-sectional diagram of the nozzle receiving member 330 in the state of FIG. 13 seen from the top. FIG. 17 is a lateral cross-sectional diagram of the nozzle receiving member 330 in the state of FIG. 13 seen from a lateral side (a deeper side of FIG. 13). FIG. 18 is an exploded perspective diagram of the nozzle receiving member 330.

The nozzle receiving member 330 is constituted by a container shutter support member 340 as a support member, a container shutter 332, a container seal 333 as a sealing member, a container shutter spring 336 as a biasing member, and a receiving member fixing portion 337. The container shutter support member 340 is constituted by a shutter rear end support portion 335 as a rear end portion, shutter side surface support portions 335*a* (protruding portions) as a side surface portions having a flat plate shape, shutter support opening portions 335*b* as side surface opening portions, and the receiving member fixing portion 337. The container shutter spring 336 is constituted by a coil spring.

A shutter side surface support portion 335*a* (protruding portion) serving as a protruding portion, and a shutter support opening portion 335*b*, which are provided on the container shutter support member 340, are provided side by side with each other in the rotation direction of the replenishing developer housing container. Two shutter side surface support portions 335*a* (protruding portions) facing each other form part of a cylindrical shape. The cylindrical shape is largely cut out at the positions of the shutter support opening portions 335*b* (two positions). With this configuration, a circular-columnar space S1 (FIG. 16) is formed in the cylindrical shape, and the container shutter 332 can be guided to move through this space in the inserting direction of the conveying nozzle 661 i.e., so as to move to an opening position to open the nozzle receiving port 331 and to move to a closing position to close the nozzle receiving port 331.

To sum up, the container body includes the protruding portions that protrude from the container body interior side of the container opening portion toward the container rear end side.

The nozzle receiving member 330 fixed into the container body 33 rotates together with the container body 33 when the container body 33 rotates. At this time, the shutter side surface support portions 335*a* (protruding portions) of the nozzle receiving member 330 rotate around the conveying nozzle 611 of the replenishing developer replenishing device 60. Therefore, the shutter side surface support portions 335*a* (protruding portions) and the shutter support opening portions 335*b* that are rotating alternately pass the region immediately above the nozzle opening 610 formed at the top portion of the conveying nozzle 611. Therefore, even if a replenishing developer deposition occurred above the nozzle opening 610 for an instant, the shutter side surface support portion 335*a* (protruding portion) would go across and collapse the replenishing developer deposition. This would prevent aggregation of replenishing developer deposition while in an idle state, and hence prevent a replenishing developer conveying failure upon resume. On the other hand, at the timing at which the shutter side surface support portions 335*a* (protruding portions) are located on the lateral sides of the conveying nozzle 611, and the shutter support opening portion 335*b* faces the nozzle opening 610, the replenishing developer will pass through the shutter support opening portion 335*b* as indicated by an arrow β in FIG. 9. Hence, the replenishing developer in the container body 33 will be supplied into the conveying nozzle 611.

The container shutter 332 is constituted by a leading end cylindrical portion 332*c* as a closing portion, a sliding portion 332*d*, a guide rod 332*e*, and shutter slip-off preventing claws 332*a*. The leading end cylindrical portion 332*c* is a portion that is on the container leading end side and hermetically contacts a cylindrical opening (the nozzle receiving port 331) of the container seal 333. The sliding portion 332*d* is a cylindrical portion that is on a more container rear end side than the leading end cylindrical portion 332*c*, has a greater external diameter than the leading end cylindrical portion 332*c*, and slides on the internal circumferential surfaces of the pair of shutter side surface support portions 335*a* (protruding portions).

The guide rod 332*e* is a rod member that rises from the cylinder interior of the leading end cylindrical portion 332*c* toward the container rear end side, and is a rod portion that, by being inserted into the coil of the container shutter spring 336, restricts the container shutter spring 336 so as not to allow the spring to buckle.

A guide rod sliding portion 332*g* is a pair of planer surfaces formed on both sides of the center axis of the guide rod 332*e* from a middle portion of the circular-columnar guide rod 332*e*. The container rear end side of the guide rod sliding portion 332*b* branches into two and forms a pair of cantilevers 332*f*.

The shutter slip-off preventing claws 332*a* are a pair of claws that are provided at an end of the guide rod 332*e* opposite from the base end thereof from which the guide rod rises, i.e., at the end of the cantilevers 332*f*, and prevent the container shutter 332 from slipping off from the container shutter support member 340.

As shown in FIG. 16 and FIG. 17, the leading end side end of the container shutter spring 336 abuts on the internal wall surface of the leading end cylindrical portion 332*c*, and the rear end side end of the container shutter spring 336 abuts on the wall surface of the shutter rear end support portion 335. At this time, the container shutter spring 336 is compressed. Therefore, the container shutter 332 receives a biasing force in a direction to be away from the shutter rear end support portion 335 (the rightward direction in FIG. 16 and FIG. 17: a direction toward the container leading end). However, the shutter slip-off preventing claws 332*a* formed on the container rear end side end of the container shutter 332 hook on the external wall surface of the shutter rear end support portion 335. This prevents the container shutter 332 from being moved in the direction to be away from the shutter rear end support portion 335 by more than the state shown in FIG. 16 and FIG. 17.

Positioning is effected by this hooking of the shutter slip-off preventing claws 332*a* on the shutter rear end support portion 335, and by the biasing force of the container shutter spring 336. Specifically, the leading end cylindrical portion 332*c* and the container seal 333, which exert the replenishing developer leakage preventing function of the container shutter 332, are positioned with respect to the container shutter support member 340 in the axial direction. They are positioned so as to hermetically contact each other, to thereby make it possible to prevent leakage of the replenishing developer.

The receiving member fixing portion 337 has a tubular shape, of which diameters on the external circumferential surface and the internal circumferential surface decrease stepwise toward the container rear end side. The diameters gradually decrease from the container leading end side to the container rear end side. As shown in FIG. 17, the external circumferential surface thereof has two external diameter portions (external circumferential surfaces AA and BB from the container leading end), and the internal circumferential surface thereof has five internal diameter portions (internal circumferential surfaces CC, DD, EE, FF, and GG from the container leading end). The boundary between the external circumferential surface AA and the external circumferential surface BB of the external circumference is a taper surface. The boundary between the fourth internal diameter portion FF and the fifth internal diameter portion GG of the internal circumferential surface is also a taper surface. The internal diameter portion FF of the internal circumferential surface and the taper surface connecting with this portion correspond to a seal member roll-in preventing space 337*b* described later, and the edge lines of these surfaces correspond to the sides of a pentagonal cross-section described later.

As shown in FIG. 16 to FIG. 18, the pair of shutter side surface support portions 335*a* (protruding portions) facing each other and having a form of a piece obtained by cutting a cylinder in the axial direction thereof protrude from the receiving member fixing portion 337 toward the container rear end side. Ends of the two shutter side surface support portions 335*a* (protruding portions) on the container rear end side connect with the shutter rear end support portion 335 having a cup shape provided with a circular hole in the center of the bottom thereof. By facing each other, the two shutter side surface support portions 335*a* (protruding portions)

internally have a circular-columnar space S1 that is recognized with their cylindrical internal wall surfaces and imaginary cylindrical surfaces extended from these surfaces. The cylindrical shape defining the receiving member fixing portion 337 has an internal diameter that is the same as the circular-columnar space S1, and has the fifth internal diameter portion GG counted from the leading end as the internal circumferential surface thereof. The sliding portion 332*d* of the container shutter 332 slides in this circular-columnar space S1 and on the cylindrical internal circumferential surface GG. The third internal circumferential surface EE of the receiving member fixing portion 337 is a circumferential surface of an imaginary circle that passes longer-direction tops of nozzle shutter striking ribs 337*a* arranged at 45[°] intervals equiangularly. The cylindrical (circular-tubular) container seal 333, of which cross-section (i.e., cross-section in the cross-sectional diagrams of FIG. 16 and FIG. 17) is a quadrangle, is provided to conform to this internal circumferential surface EE. The container seal 333 is fixed on a vertical surface that connects the third internal circumferential surface EE with the fourth internal circumferential surface FF with an adhesive, a double-face tape, or the like. The exposed surface of the container seal 333, which is on the opposite side (the right-hand side in FIG. 16 and FIG. 17) from this adhesive surface, constitutes the inner bottom of a cylindrical opening of the cylindrical receiving member fixing portion 337 (or of the container opening portion).

As shown in FIG. 16 and FIG. 17, a seal member roll-in preventing space 337*b* (a tucking preventing space) is formed so as to correspond to the internal circumferential surface FF of the receiving member fixing portion 337 and the taper surface extending from this surface. The seal member roll-in preventing space 337*b* is a ring-shaped sealed space enclosed by three different members. That is, it is a ring-shaped space enclosed by the internal circumferential surface (the fourth internal circumferential surface FF and the taper surface extending from this) of the receiving member fixing portion 337, the vertical surface of the container seal 333 at which it is adhesively fixed, and the external circumferential surface of the container shutter 332 from the leading end cylindrical portion 332*c* to the sliding portion 332*d*. The cross-section (i.e., the cross-section in the cross-sectional diagram of FIG. 16 and FIG. 17) of this ring-shaped space is a pentagonal shape. The angle formed between the internal circumferential surface of the receiving member fixing portion 337 and the end surface of the container seal 333, and the angle formed between the external circumferential surface of the container shutter 332 and the end surface of the container seal 333 are both 90[°].

The function of the seal member roll-in preventing space 337*b* will be described. When the container shutter 332 is moved from a state of closing the nozzle receiving port 331 toward the container rear end, the internal circumferential surface of the container seal 333 slides relative to the leading end cylindrical portion 332*c* of the container shutter 332. Hence, the internal circumferential surface of the container seal 333 is dragged by the container shutter 332 and elastically deformed so as to move toward the container rear end.

At this time, if there is no seal member roll-in preventing space 337*b*, and the vertical surface (the adhesive surface of the container seal 333) connecting with the third internal circumferential surface connects with the fifth internal circumferential surface GG orthogonally, there is a risk of the following state. Specifically, the elastically deformed portion of the container seal 333 is tucked in and rolled in between the internal circumferential surface of the receiving member fixing portion 337 sliding relative to the container shutter 332 and the external circumferential surface of the container shutter 332. If the container seal 333 is rolled in between the sliding portions of the receiving member fixing portion 337 and container shutter 332, i.e., between the internal circumferential surface GG and the leading end cylindrical portion 332*c*, the container shutter 332 is locked to the receiving member fixing portion 337 and cannot open or close the nozzle receiving port 331.

Compared with this, the nozzle receiving member 330 of the present embodiment has the seal member roll-in preventing space 337*b* formed at the internal circumference thereof. The internal diameters of the seal member roll-in preventing space 337*b* (i.e., the internal diameters of the internal circumferential surface EE and of the taper surface extending from this surface) are smaller than the external diameter of the container seal 333. Therefore, the container seal 333 as a whole would not enter the seal member roll-in preventing space 337*b*. Further, there is a limit to a range of the container seal 333 that may be dragged by the container shutter 332 and elastically deformed, and the container seal will return by its own elasticity before reaching the internal circumferential surface GG and getting rolled in. With this effect, it is possible to prevent making it impossible to perform opening or closing of the nozzle receiving port 331 due to the container shutter 332 being locked to the receiving member fixing portion 337.

As shown in FIG. 16 to FIG. 18, a plurality of nozzle shutter striking ribs 337*a* are formed on the internal circumferential surface of the receiving member fixing portion 337 adjoining the external circumference of the container seal 333 such that the ribs extend radially. As shown in FIG. 16 and FIG. 17, when the container seal 333 is fixed on the receiving member fixing portion 337, a vertical surface of the container seal 333 on the container leading end side slightly sticks out from the container leading end side end of the nozzle shutter striking ribs 337*a* in the rotational axis direction.

When the replenishing developer housing container 32 is mounted on the replenishing developer replenishing device 60 as shown in FIG. 9, a nozzle shutter flange 612*a* of the nozzle shutter 612 of the replenishing developer replenishing device 60 is biased by a nozzle shutter spring 613 and crushes the stuck-out portion of the container seal 333. The nozzle shutter flange 612*a* goes further inward, strikes on the container leading end side end of the nozzle shutter striking ribs 337*a*, and covers the leading end side end surface of the container seal 333 to thereby provide a shield from the outside of the container. This ensures hermetical seal around the conveying nozzle 611 in the nozzle receiving port 331 while in the mounted state, and can prevent replenishing developer leakage.

The rotational axis direction position of the nozzle shutter 612 relative to the replenishing developer housing container 32 is determined by the nozzle shutter striking ribs 337*a* being struck by such a surface of the nozzle shutter flange 612*a* biased by the nozzle shutter spring 613 as is opposite to a nozzle shutter spring receiving surface 612*f* thereof. As a result, a rotational axis direction positional relationship among the container leading end side end surface of the container seal 333, the container leading end side end surface of a leading end opening 305 (a later-described internal space of the cylindrical receiving member fixing portion 337 provided in the container opening portion 33*a*), and the nozzle shutter 612 is determined.

Figure 19A:
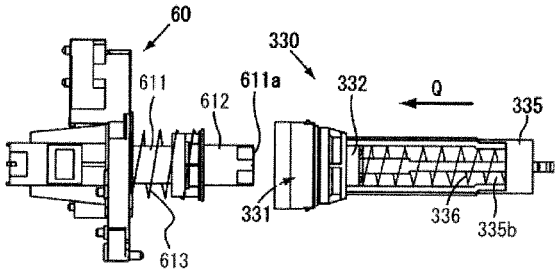
FIG. 19A is a top plan view of an example for explaining a state of an opening/closing member and a conveying pipe being mounted on each other.
Figure 19B:
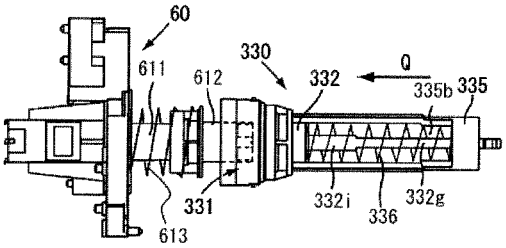
FIG. 19B is a top plan view of an example for explaining a state of an opening/closing member and a conveying pipe being mounted on each other.
Figure 19C:
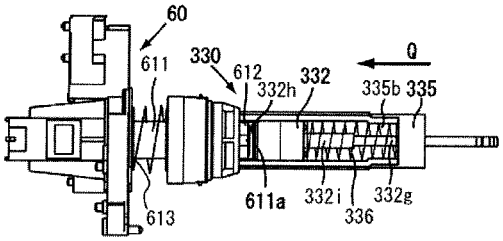
FIG. 19C is a top plan view of an example for explaining a state of an opening/closing member and a conveying pipe being mounted on each other.
Figure 19D:
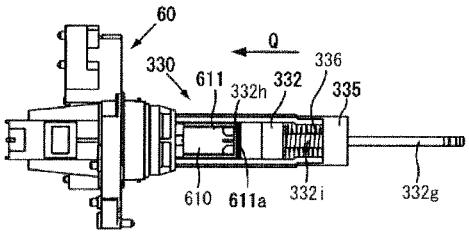
FIG. 19D is a top plan view of an example for explaining a state of an opening/closing member and a conveying pipe being mounted on each other.

Next, the operation of the container shutter 332 and the conveying nozzle 611 will be explained with reference to FIG. 1, FIG. 9, and FIG. 19A to FIG. 19D. Before the replenishing developer housing container 32 is mounted on the replenishing developer replenishing device 60, the container shutter 332 is biased by the container shutter spring 336 to a closing position of closing the nozzle receiving port 331 as shown in FIG. 1. FIG. 19A shows the appearance of the container shutter 332 and the conveying nozzle 611 in this state. When the replenishing developer housing container 32 is mounted on the replenishing developer replenishing device 60, the conveying nozzle 611 is inserted into the nozzle receiving port 331 as shown in FIG. 19B. When the replenishing developer housing container 32 is pushed further into the replenishing developer replenishing device 60, an end surface 332*h* of the leading end cylindrical portion 332*c*, which is the end surface of the container shutter 332 (hereinafter referred to as "container shutter end surface 332*h*"), and an end surface 611*a* of the conveying nozzle 611 located at a side from which the nozzle is inserted (hereinafter referred to as conveying nozzle end surface 611*a*") contact each other. When the replenishing developer housing container 32 is pushed further from this state, the container shutter 332 is thrust down as shown in FIG. 19C, and the conveying nozzle 611 is inserted into the shutter rear end support portion 335 through the nozzle receiving port 331 as shown in FIG. 19D. As a result, the conveying nozzle 611 is inserted into the container body 33 and comes to the set position as shown in FIG. 9. At this time, the nozzle opening 610 is at a position coinciding with the shutter support opening portion 335*b* as shown in FIG. 19D.

After this, when the container body 33 rotates, the replenishing developer uplifted above the conveying nozzle 611 by the uplifting portion 304 falls into and is introduced into the conveying nozzle 611 from the nozzle opening 610. The replenishing developer introduced into the conveying nozzle 611 is conveyed through the conveying nozzle 611 toward the replenishing developer fall-down conveying path 64 along with rotation of the conveying screw 614, and falls through the replenishing developer fall-down conveying path 64 to be supplied into the developing device 50.

Figure 34:
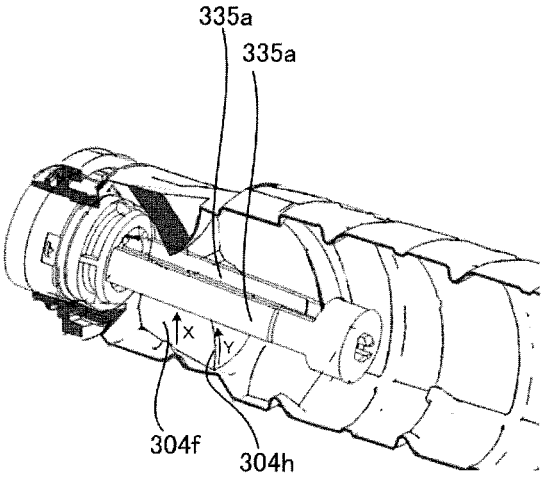
FIG. 34 is a perspective cross-sectional diagram showing a configuration of a replenishing developer housing container of the present invention.

In the region of the cross-section along the line E-E of FIG. 9 (which is the leading end side of the conveying nozzle 611 and a position of an end surface of a bearing of the conveying screw 614), the bosses 304*h* and the shutter side surface support portions 335*a* (protruding portions) are at positions facing each other. The uplifting wall surfaces 304*f* rise from the internal wall surface of the container so as to extend in the direction X of FIG. 30 (and the direction represented by the arrow X in FIG. 34), i.e., toward the shutter side surface support portions 335*a*. The bosses 304*h* rise in the direction represented by the arrow Y in FIG. 34, i.e., toward the shutter side surface support portions 335*a*.

Further, at the region where the shutter side surface support portion 335*a* and the boss face each other, the boss 304*h* curves outward in the radial direction of the container so as to conform to the contour of the shutter side surface support portion 335*a* (a curving portion 304*i*). In other words, the boss dents from the internal side toward the external side in the radial direction.

This denting portion of the boss is referred to as curving portion 304*i*.

The curving portion 304*i* is gentler than other portions of the boss 304*h* and conforms to the shutter side surface support portion 335*a* also in the longer direction.

In FIG. 32, the portion in the enclosure indicated by a sign Z curves toward the deeper side of the drawing, and the curving portion 304*i* is formed at this portion.

Likewise, the uplifting wall surface 304*f* also faces the shutter side surface support portion 335*a*. When seen from the container rotation direction downstream side, there are the uplifting wall surface 304*f*, a rotation direction downstream side end surface 335*c* (a flat side surface) of the shutter side surface support portion 335*a* (protruding portion), and a rotation direction upstream side lateral edge portion 611*s* of the nozzle opening 610. When the conveying nozzle 611 is inserted, the shutter side surface support portions 335*a* as the protruding portions extend along the conveying nozzle 611.

Also by means of the uplifting portion 304 formed by the uplifting wall surfaces 304*f* of the container body 33 shown in FIG. 30 likewise by means of the uplifting effect explained earlier, the replenishing developer moves as indicated by an arrow T1 into the nozzle opening 610, which is an opening of the conveying nozzle 611 as a conveying pipe.

At this time, the external circumferential surface and rotation direction downstream side end surface 335*c* (flat side surface) of the shutter side surface support portion 335*a* (protruding portion) function as a replenishing developer pass-down for passing the replenishing developer from the uplifting portion 304 into the nozzle opening 610.

FIG. 30 also shows the flow of the replenishing developer in the container body 33 including the shutter side surface support portions 335*a* (protruding portions) functioning as the pass-down portion.

Along with the rotation of the container body 33 in the direction of the arrow A in the drawing, the replenishing developer uplifted by the uplifting wall surface 304*f* along the circumferential direction of the container body flows toward the direction of the nozzle opening 610 due to the gravity force (the arrow T1 in the drawing). In the configuration shown in FIG. 30, the shutter side surface support portions 335*a* (protruding portions) are arranged so as to fill the gaps between the conveying nozzle 611 and the bosses 304*h* (the bosses protruding toward the center of rotation of the uplifting wall surfaces 304*f*). So as to realize this arrangement, the rotation direction downstream side end surface 335*c* (flat side surface) of the shutter side surface support portion 335*a* (protruding portion) and the boss 304*h* of the uplifting portion 304 are arranged in this order as seen from the downstream side in the direction of rotation of the container body 33.

The presence of the curving portion 304*i* of the boss 304*h* enables the boss 304*h* and the uplifting wall surface 304*f* to conform even more to the shutter side surface support portion 335*a* to thereby make the shutter side surface support portion 335*a* effectively function in passing the replenishing developer from the uplifting wall surface into the nozzle opening.

This arrangement allows the uplifted replenishing developer to efficiently enter the nozzle opening 610.

Additionally, the replenishing developer contains a toner and a carrier, so that an amount of the replenishing developer remaining in the container body 33 upon replacing the replenishing developer housing container 32 can be reduced.

It is better to make the shutter side surface support portion 335*a* (protruding portion) and the boss 304*h* closely contact each other. However, to save the manufacturing costs, the boss 304*h*, the uplifting wall surface 304*f*, and the curving portion 304*i* are often manufactured with blow molding, which cannot be as dimensionally precise as injection molding. With blow molding, it is difficult to form a completely close contact with the shutter side surface support portion, and it is preferable to manufacture them with a slight gap in terms of mass productivity. In the present embodiment, the distance between the curving portion and the shutter side surface support portion facing the curving portion is from about 0.3 mm to about 1 mm.

To sum up, the present embodiment includes the following useful features:

suppressing scatter, etc. of the replenishing developer with the configuration of inserting the nozzle on the apparatus body into the container; and improving the replenishing developer replenishing efficiency with the utilization of the shutter side surface support portion as a bridge to pass the replenishing developer from the uplifting wall surface into the nozzle.

However, as stated above, the boss 304*h* and the uplifting wall surface 304*f* are often manufactured with blow molding, which cannot be as dimensionally precise as injection molding. Therefore, it is difficult to form a completely close contact with the shutter side surface support portion 335*a*. Even through employing the above-described configuration, the replenishing developer cannot be sufficiently conveyed to the conveying nozzle in some cases. Similarly, in the case where the uplifting wall surface is shaped in order to improve a function of conveying the replenishing developer, the replenishing developer cannot be sufficiently conveyed to the conveying nozzle in some cases.

Note that, this problem is pronounced in the blow molding, but it is also difficult to achieve a high dimensional precision between the boss and the shutter side surface support portion in the case where other molding methods are used. Therefore, a container body of the present invention is not limited to a blow molded product.

The present inventors believes that the following factors results in that the replenishing developer cannot be sufficiently conveyed to the conveying nozzle as stated above.

Figure 35:
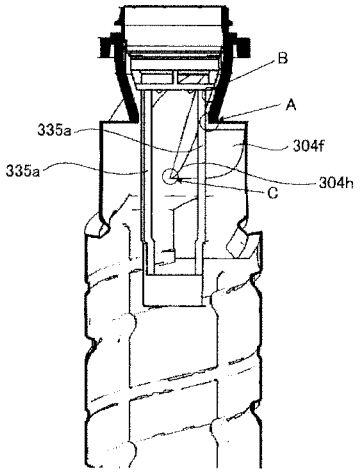
FIG. 35 is a cross-sectional diagram showing a configuration of a replenishing developer housing container of the present invention.

The first factor is believed as follows. When the replenishing developer has the high flowability, the replenishing developer runs down from a region between the shutter side surface support portion 335*a* and the rising portion (boss 304*h*), that is, a region indicated by A in FIG. 35. This is believed to lead to a decrease of an amount of the replenishing developer supplied to the conveying nozzle 611. This is believed to be pronounced in the replenishing developer having the high flowability.

The second factor is as follows. As seen from the longer direction, the uplifting wall surface 304*f* is provided so as to incline toward the opening portion (incline outwardly in an axis direction of the container body), and configured to be gradually away from the boss 304*h* which is the most close to the conveying nozzle 611 (a region indicated by B in FIG. 35). This configuration is effective for uplifting the replenishing developer and conveying it to the proximity to the nozzle opening. However, the configuration allows a gap between the conveying nozzle 611 and the boss 304*h* to widen as it approaches the container leading end side. Therefore, the replenishing developer runs down from between the shutter side surface support portions 335*a* and the uplifting wall surface 304*f*. This is believed to lead to a decrease of an amount of the replenishing developer supplied to the conveying nozzle 611. This is believed to be pronounced in the replenishing developer having the high flowability.

The third factor is as follows. As seen from the longer direction, the replenishing developer moves from the container rear end side of the uplifting wall surface 304*f* to the proximity to the shutter side surface support portions 335*a* toward the leading end side (a region indicated by C in FIG. 35), during which a part of the replenishing developer runs down from the uplifting wall surface 304*f*. Upon running down from the uplifting wall surface 304*f*; of course, the replenishing developer is not conveyed to the conveying nozzle 611. Therefore, an amount of the replenishing developer supplied to the conveying nozzle 611 is believed to be decreased by an amount of the replenishing developer which had been run down. This is also believed to be one of factors causing that the above-described phenomenon is pronounced in the replenishing developer having the high flowability.

The fourth factor is as follows. A replenishing developer having the low flowability is impossible to be discharged in the first place.

It is believed that the above-described factors are associated with each other to cause a difference in a discharging property of the replenishing developer which is discharged from inside of the container to outside of the container.

The discharging property of the replenishing developer is a critical problem when a residual amount of the replenishing developer is decreased.

In a state in which the replenishing developer remains in a large amount, the replenishing developer is discharged by the action of the conveying force of the spiral conveying portion of the replenishing developer housing container body. In a state in which the replenishing developer remains in only a small amount, the replenishing developer cannot be poured into the nozzle opening 610 in some cases depending on configurations of the uplifting portion and the passing means.

When the replenishing developer having the suitable flowability is used, the problem is solved as follows.

With respect to the first and second factors, appropriate aggregation force between particles allows the replenishing developer to be less likely to enter a gap and to override a gap when the gap is small. Therefore, even when there is a gap, the replenishing developer is supplied to the nozzle. Depending on the aggregation, even when the replenishing developer enter the gap, the replenishing developer does not fall down and pass through the gap, and the replenishing developer in the gap form an aggregate in situ to thereby play a role of filling the gap.

With reference to the third factor, appropriate aggregation force between particles allows the replenishing developer to be less likely to be spilled out to thereby improve an uplifting efficiency.

With reference to the fourth factor, an improvement of the flowability allows the replenishing developer to be smoothly conveyed.

When the replenishing developer housing container 32 is in the set position shown in FIG. 19D, the container shutter end surface 332*h* is pushed by the conveying nozzle end surface 611*a* within the region of the nozzle opening 610. At this time, the nozzle opening 610, and the conveying nozzle end surface 611*a* and the container shutter end surface 332*h* as well are located below the uplifting portion 304. Therefore, the replenishing developer uplifted above the conveying nozzle 611 falls into the nozzle opening 610, and into between the container shutter end surface 332*h* and the conveying nozzle end surface 611*a* as well. Furthermore, the fallen toner in the replenishing developer may float up and deposit between the container shutter 332 and the container shutter support member 340.

Here, if it is assumed that the container shutter end surface 332*h* and the conveying nozzle end surface 611*a* are flat surfaces, the container shutter end surface 332*h* and the conveying nozzle end surface 611*a* contact each other by surface slide, and they are heavily loaded as a result. It is difficult for them to have an ideally perfect interfacial slide due to errors in assembly and variations in parts, and they have a slight gap between them. Therefore, the toner may enter this gap, and be frictioned along with the surface slide.

Further, assume a case where the toner floating up in the replenishing developer housing container deposits between the container shutter 332 and the container shutter support member 340. In the state that the replenishing developer housing container 32 is mounted on the replenishing developer replenishing device 60, a braking force is applied to the container shutter because the leading end cylindrical portion 332*c* of the container shutter 332 is pushed onto the conveying nozzle end surface 611*a* by the container shutter spring 336. Consequently, it is considered that the container shutter 332 does not rotate in conjunction with the container shutter support member 340 that is fixed on the container body 33 and is rotating synchronously with the spiral projection 302. In this case, it is predicted that the toner between the container shutter 332 and the container shutter support member 340 may be frictioned by the container shutter 332.

In this case, the toner that is frictioned and applied a load as a result may form an aggregate that is larger than the particle diameter of a toner that is not applied a load. If the aggregate is conveyed into the developing device 50 through the replenishing developer replenishing device 60, abnormal images such as undesired black spots may be produced. This phenomenon of forming an aggregate is more often the case with, particularly, a low melting point toner that can form an image at a low fixing temperature, among toners used for the replenishing developer.

Hence, in the present invention, it is preferable to provide an aggregation suppressing unit configured to suppress aggregation of a toner that may occur along with rotation of the container body 33, as will be explained below.

As the aggregation suppressing unit, the container shutter 332 is let to rotate in conjunction with the container shutter support member 340 even when the leading end cylindrical portion 332*c* of the container shutter 332 is pushed onto the conveying nozzle 611 by being pushed in the longer direction thereof by the container shutter spring 336 and is applied a braking force as the result of being pushed. This preventing effect reduces the sliding load to be applied to the toner between the container shutter 332 and the container shutter support member 340. As a conjunctive rotation (relative rotation), a rotation of the container shutter 332 about the axis of the guide rod 332*e* is assumed. A state that the container shutter 332 rotates in conjunction with the container shutter support member 340 means a state that both of them rotate simultaneously, in other words, a state that the container shutter 332 does not rotate relative to the container shutter support member 340. As the region between the container shutter 332 and the container shutter support member 340, the region between the external circumferential surface of the sliding portion 332*d* and the internal circumferential surface of the shutter support opening portion 335*b*, and the region between the guide rod sliding portion 332*g* and a rear end opening 335*d* are assumed.

The sliding load to the replenishing developer is much larger in a rotation operation about the axis than in an opening/closing operation of the container shutter 332 in the axial direction, because the opening/closing operation occurs only when the replenishing developer housing container 32 is mounted or demounted, whereas the rotation operation occurs every time a replenishing operation is performed.

Figure 20A:
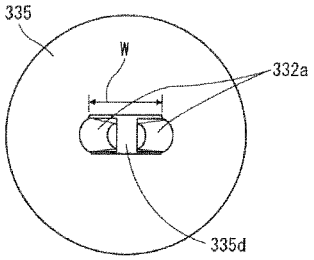
FIG. 20A is an enlarged diagram showing a relationship among a rear end opening, shutter slip-off preventing claws, and a planar guide seen from a container rear end side in one embodiment.
Figure 20B:
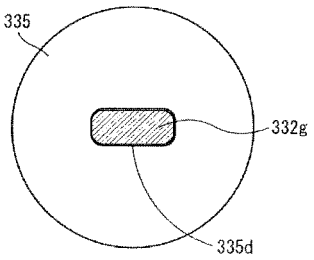
FIG. 20B is an enlarged diagram showing a relationship among a rear end opening, shutter slip-off preventing claws, and a planar guide seen from a container rear end side in one embodiment.

FIG. 20A is a plan view showing a relationship between a rear end opening 335*d* as a through-hole in the center of the opening/closing member rear end support portion and the shutter slip-off preventing claws 332*a* as seen from the left-hand side of FIG. 17 (from the container rear end side). FIG. 20B is a cross-sectional diagram of the guide rod sliding portion 332*g* showing an engaging relationship between the rear end opening 335*d* and the guide rod sliding portion 332*g* in the state of FIG. 19C.

The guide rod 332*e* is constituted by a cylindrical portion 332*i*, the guide rod sliding portion 332*g*, the cantilevers 332*f*, and the shutter slip-off preventing claws 332*a*. As shown in FIG. 17, the guide rod 332*e* of the container shutter 332 is divided into two at the container rear end side thereof to thereby form the pair of cantilevers 332*f*. The shutter slip-off preventing claws 332*a* are provided on the external circumferential surfaces of the cantilevers respectively. As shown in FIG. 17 and FIG. 20A, the shutter slip-off preventing claws 332*a* protrude more outward than the external edges of the longer-direction length W of the rear end opening 335*d*. The rear end opening 335*d* has a function of letting the cantilevers 332*f* and the guide rod sliding portion 332*g* slide relative to the rear end opening 335*d* to guide the container shutter 332 to move. As shown in FIG. 20B, the guide rod sliding portion 332*g* has flat surfaces facing the top and bottom sides of the rear end opening 335*d*, and has curving surfaces conforming to the left and right aides of the rear end opening 335*d*. The cylindrical portion 332*i* forms a cylindrical shape, of which width in the left-right direction in FIG. 20A and FIG. 20B is the same as that of the guide rod sliding portion 332*g*. The cantilevers 332*f* and the guide rod sliding portions 332*g* are engaged with the rear end opening 335*d* in such a relationship as not to be inhibited from moving when the container shutter 332 moves as shown in FIG. 19A to FIG. 19D. In this way, the rear end opening 335*d* has the cantilevers 332*f* and the guide rod sliding portion 332*g* inserted therethrough and guides the container shutter 332 to move, and regulates rotation of the container shutter 332 about the rotation axis as well.

When assembling the container shutter 332 on the container shutter support member 340, the guide rod 332*e* is inserted through the container shutter spring 336, and the pair of cantilevers 332*f* of the guide rod 332*e* are warped toward the axial center of the guide rod 332*e* to let the shutter slip-off preventing claws 332*a* pass through the rear end opening 335*d*. As a result, the guide rod 332*e* is assembled on the nozzle receiving member 330 as shown in FIG. 15 to FIG. 17. At this time, the container shutter 332 is pressured by the container shutter spring 336 in the direction to close the nozzle receiving port 331, and the container shutter is prevented from slipping off by the shutter slip-off preventing claws 332*a*. The guide rod 332*e* is preferably made of a resin such as polystyrene so that the cantilevers 332*f* may have elasticity to warp.

When the replenishing developer housing container 32 is set in the set position, the guide rod sliding portion 332*g* passes through the rear end opening 335*d*, and comes to a position at which the flat portions of the guide rod sliding portion 332*g* as a driving force receiving portion and the sides of the rear end opening 335*d* as a driving force transmitting portion face and contact each other as shown in FIG. 19D and FIG. 20B. At this position, the internal circumferential surfaces of the shutter side surface support portions 335*a* (protruding portions) face the external circumferential surfaces of the leading end cylindrical portion 332*c* and the sliding portion 332*d*.

Accordingly, even though the container shutter end surface 332*h* is pushed onto the conveying nozzle end surface 611*a* by being pushed by the container shutter spring 336, the container shutter 332 is fixed to the rotating container shutter support member 340 in the direction of rotation about the longer axis thereof (i.e., the center axis of the guide rod 332*e*, and at the same time, the axis of rotation of the container body 33), by means of the surface contact between the flat portions of the guide rod sliding portion 332*g* and the sides of the rear end opening 335*d*. As a result, a rotational force is transmitted to the guide rod 332*e* of the container shutter 332 from the container shutter support member 340 that is rotating. Because this rotational force is greater than the braking force described above, the container shutter 332 rotates along with the rotation of the container shutter support member 340. In other words, the container shutter 332 is in conjunction with the rotation of the container shutter support member 340 (at this time, both of them are restricted from relative rotation). That is, the guide rod sliding portion 332*g* and the rear end opening 335*d* function as a driving transmitting unit that transmits a rotational force from the container shutter support member 340 to the container shutter 332. At the same time, they can be described as the aggregation suppressing unit. This aggregation suppressing unit suppresses sliding friction of the toner between the container shutter 332 and the container shutter support member 340 in the direction of rotation about the axis of the guide rod 332*e*. This makes it possible to suppress toner aggregation between the container shutter 332 and the container shutter support member 340 along with the rotation of the container body 33.

The aggregation suppressing unit is not limited to the guide rod sliding portion 332*g*, but may be the cantilevers 332*f*. In this case, the length and position of the cantilevers 332*f* may be determined such that they are positioned at the rear end opening 335*d* when the replenishing developer housing container 32 is in the set position.

Another aggregation suppressing unit will be explained. First, the problem to be solved by this aggregation suppressing unit will be described. When the container shutter 332 rotates simultaneously with the replenishing developer housing container 32 (container body 33), the container shutter end surface 332*h* rotates relative to the conveying nozzle end surface 661*a*. The leading end cylindrical portion 332*c* of the container shutter 332 is pushed onto the conveying nozzle 611 in the longer direction thereof by being pushed by the container shutter spring 336. When this relative rotation occurs in this state, the container shutter end surface 332*h* applies an extremely heavy sliding load to the conveying nozzle end surface 661*a*, which may be the cause of occurrence of a toner aggregate.

Hence, there is proposed a second aggregation suppressing unit, which suppresses toner aggregation that may be caused along with rotation of the container shutter 332 as an opening/closing member, and which aims to suppress occurrence of a toner aggregate in a region different from the region in the embodiment described above. The aggregation suppressing unit described below reduces a sliding load on the toner in a region where the conveying nozzle end surface 611*a* and the facing leading end cylindrical portion 332*c* abut on each other.

As shown in FIG. 9 and FIG. 14, the container shutter end surface 332*h* includes an abutment part 342 that projects from the end surface 332*h* toward the facing end surface 611*a* of the conveying nozzle 611 (or outward from the container leading end) and abuts on the end surface 611*a* of the conveying nozzle 611 when the replenishing developer housing container is mounted on an image forming apparatus. The abutment part 342 is a projecting portion functioning as the aggregation suppressing unit (second aggregation suppressing unit) of the present embodiment. The external circumferential surface of the abutment part 342 has a shape that includes a circular circumferential surface concentric with the axis of rotation of the replenishing developer housing container 32 and reduces its diameter toward the conveying nozzle end surface 611*a* (e.g., a hemispherical shape), and the abutment part 342 is provided to have a point contact with the conveying nozzle end surface 611*a* at the top of the hemispherical shape as shown in FIG. 9. This allows rotation to occur in a state that the sliding load when the abutment part 342 abuts on the conveying nozzle end surface 611*a* is low. Hence, the contact area can be much less than when the container shutter end surface 332*h* and the conveying nozzle end surface 611*a* have flat surfaces. This makes it possible to reduce a sliding load to be applied to the toner between the container shutter end surface 332*h* and the conveying nozzle end surface 611*a* along with the rotation of the container body 33, and thereby to suppress aggregation of the toner.

The material of the abutment part 342 may be the same as the container shutter 332, e.g., polystyrene resin, when formed integrally with the container shutter 332. Since the container shutter 332 is a component assembled on the replenishing developer housing container 32, it is replaced together with the replenishing developer housing container 32. Therefore, on the premise that it may be replaced, the material of the abutment part 342 that is to rotate by keeping in contact with the conveying nozzle end surface 611*a* is, in terms of durability, preferably a material softer than the material of the conveying nozzle 611 (end surface 611*a*) that is set in the printer section 100 and is not to be replaced in principle.

As shown in FIG. 9 and FIG. 14, the abutment part 342 is arranged roughly in the center of the container shutter end surface 332*h*, so as to be present on the axis of rotation of the replenishing developer housing container 32, in other words, on the axis of rotation of the container shutter 332. With such an arrangement, the locus of rotation of the top of the abutment part 342 when the container shutter end surface 332*h* rotates relative to the conveying nozzle end surface 661*a* is ideally one point. Because components different from each other, namely, the replenishing developer housing container and an image forming apparatus, are mounted on each other, they cannot avoid being positionally misaligned from each other within an allowable error, and there may also be variation due to mass production. Even in consideration of these factors, it is possible to make the locus of rotation infinitesimal. By doing so, it is possible to save the contact area between the container shutter end surface 332*h* and the conveying nozzle end surface 611*a*, and to suppress aggregation of the toner due to a sliding load.

Figure 21:
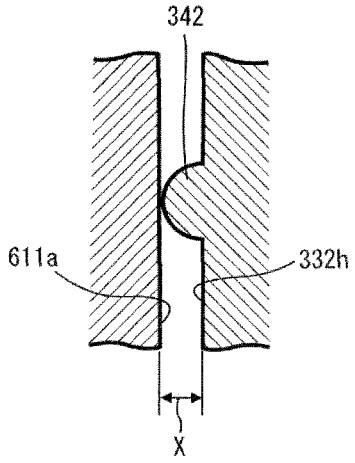
FIG. 21 is an enlarged cross-sectional diagram showing a state of an opening/closing member and a conveying pipe abutting on each other in another embodiment.

Next, an interfacial gap between the container shutter end surface 332*h* and the conveying nozzle end surface 611*a* formed by the abutment part 342 will be explained. As shown in FIG. 21, this gap is set by the amount X of projection of the abutment part 342 from the container shutter end surface 332*h* to the top thereof.

Figure 22:
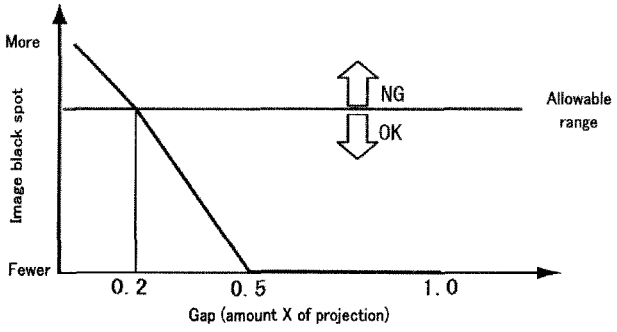
FIG. 22 is a diagram showing an expected relationship between an amount of projection of an aggregation suppressing unit and occurrence of black spots in an image in another embodiment.

The present inventors have studied the relationship between the amount X of projection and occurrence of black spots in the images, i.e., the relationship between a sliding area of the abutment region and occurrence of black spots in the images, and found the tendency shown in FIG. 22. In the present embodiment, the amount X of projection (the interfacial gap) is set to 1 mm. Hence, the toner that enters the interfacial gap receives a less sliding load, and easily falls out of the range of the surfaces and scarcely remains there, which makes it difficult for an aggregate to occur. In this way, the load to the toner is suppressed, because the sliding load when the toner enters the gap between the container shutter end surface 332*h* and the conveying nozzle end surface 611*a* is suppressed. Therefore, it is possible to minimize a load to be applied to the toner, and to thereby suppress occurrence of an aggregate and abnormal images.

As shown in FIG. 22, it is safe if the amount X of projection (interfacial gap) is 0.5 mm or greater. It is estimated that such a level of an aggregate that could be recognized on an output image would be likely to occur when the amount of projection is roughly 0.2 mm or less. Hence, the amount X of projection (interfacial gap) is preferably from about 0.5 mm to about 1 mm.

Figure 23:
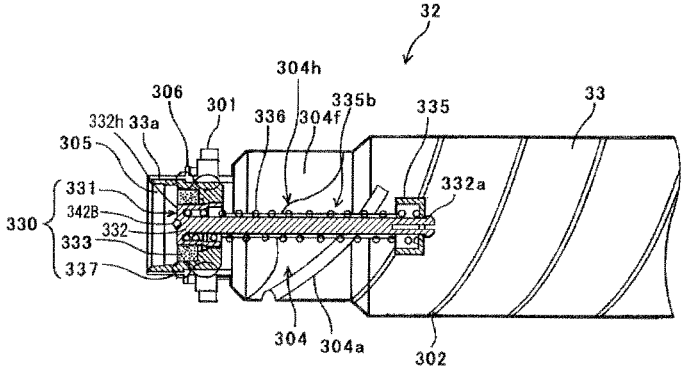
FIG. 23 is an enlarged diagram showing another configuration of an aggregation suppressing unit in another embodiment.

The aggregation suppressing unit is not limited to the one obtained by integrally molding the abutment part 342 and the container shutter 332 as shown in FIG. 21. For example, the aggregation suppressing unit may be separated from the container shutter 332 as shown in FIG. 23. Also in this case, the same effect as that described above can be obtained as long as the amount X of projection is secured. The aggregation suppressing unit shown in FIG. 23 includes an abutment part 342B, which is a sphere made of a resin and provided roughly in the center of the container shutter end surface 332*h* free to roll.

Also with this configuration, the sliding load to be applied to the toner that enters the interfacial gap between the container shutter end surface 332*h* and the conveying nozzle end surface 611*a* is suppressed. Therefore, it is less likely for an aggregate to occur. In this way, a load to the toner is suppressed, because the sliding load when the toner enters the interfacial gap between the container shutter end surface 332*h* and the conveying nozzle end surface 611*a* is suppressed. This makes it possible to minimize the load to the toner, and to thereby suppress occurrence of an aggregate and abnormal images.

Figure 24:
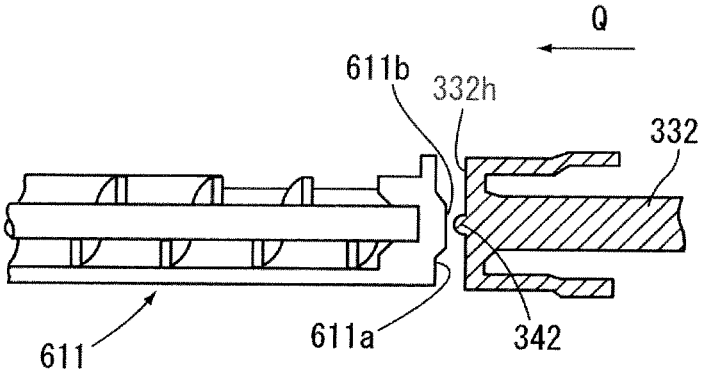
FIG. 24 is an enlarged diagram showing a modified example of an end surface of a conveying pipe.

The conveying nozzle end surface 611*a* is a flat planar end surface. However, as shown in FIG. 24, the end surface 611*a* may be formed such that only a portion 611*b* of the conveying nozzle end surface 611*a* that faces the abutment part 342 projects toward the abutment part 342.

Another aggregation suppressing unit will be explained.

The aggregation suppressing unit described above is provided between the container shutter end surface 332*h* and the conveying nozzle end surface 611*a*, and is therefore particularly effective for suppressing generation of a toner aggregate. However, it is predicted that when the replenishing developer housing container 32 is demounted from the replenishing developer replenishing device 60, the toner deposited between the surfaces may fall into the image forming apparatus or onto the floor to thereby contaminate them.

Hence, the present aggregation suppressing unit includes a seal member 350 that is provided on a non-abutment region R of the container shutter end surface 332*h* that is not to abut on the conveying nozzle end surface 611*a*. This makes it possible to prevent the toner from remaining in the interfacial gap between the container shutter end surface 332*h* and the conveying nozzle end surface 611*a*.

Figure 25:
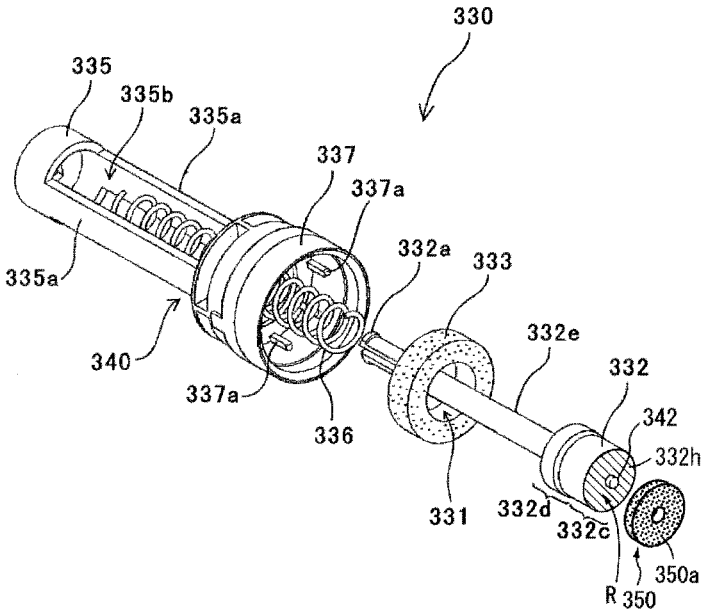
FIG. 25 is an enlarged perspective diagram showing a configuration of main portions in another embodiment.
Figure 26:
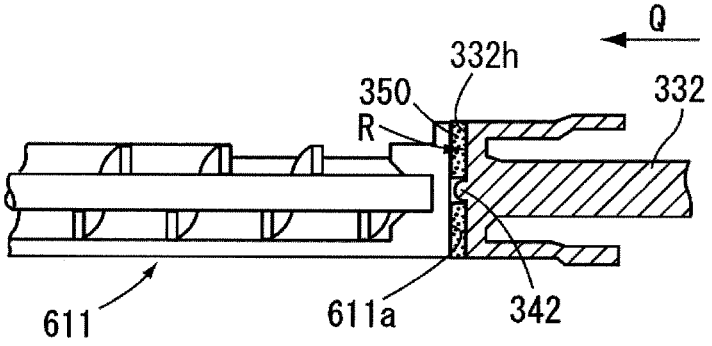
FIG. 26 is an enlarged cross-sectional diagram showing a state of an opening/closing member and a conveying pipe abutting on each other in another embodiment.
Figure 27:
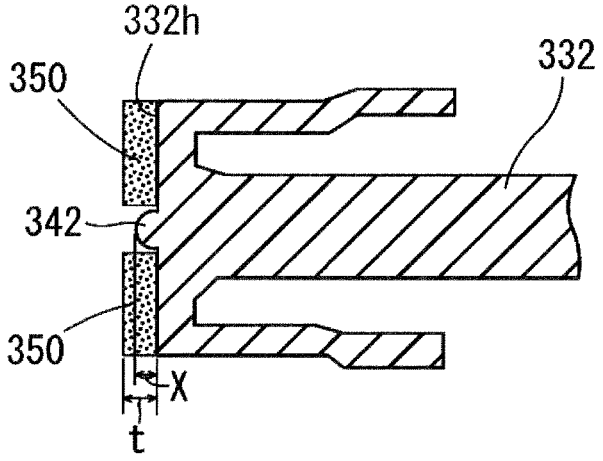
FIG. 27 is an enlarged cross-sectional diagram explaining a configuration of a seal member provided at an end surface of an opening/closing member and an aggregation suppressing unit in another embodiment.

The seal member 350 is made of an elastic material such as polyurethane foam. As shown in FIG. 25 and FIG. 26, the seal member 350 is formed in an annular shape so as to be located on the external side of the abutment part 342. The seal member 350 is configured to compress by from 0.1 mm to 0.5 mm in the direction of the thickness of the seal member 350, when the container shutter 332 comes to the opening position of opening the nozzle receiving port 331 along with the conveying nozzle 611 being inserted into the replenishing developer housing container 32. Specifically, when the amount X of projection of the abutment part 342 is 1 mm as shown in FIG. 27, the thickness t of the seal member 350 is set to from 1.1 mm to 1.5 mm. The seal member 350 is designed to collapse and thereby allow the conveying nozzle end surface 611*a* and the abutment part 342 to abut on each other when a facing surface 350*a* of the seal member 350 and the conveying nozzle end surface 611*a* contact each other.

Providing the seal member 350 in this way makes it difficult for the toner to enter the interfacial gap, because the facing surface 350*a* of the seal member 360 contacts the conveying nozzle end surface 611*a* before the conveying nozzle end surface 611*a* and the abutment part 342 abut on each other, as shown in FIG. 26. This makes it possible to suppress the interior of the image forming apparatus or the floor from being contaminated by toner that would otherwise fall there when the replenishing developer housing container 32 is demounted from the replenishing developer replenishing device 60.

Figure 29:
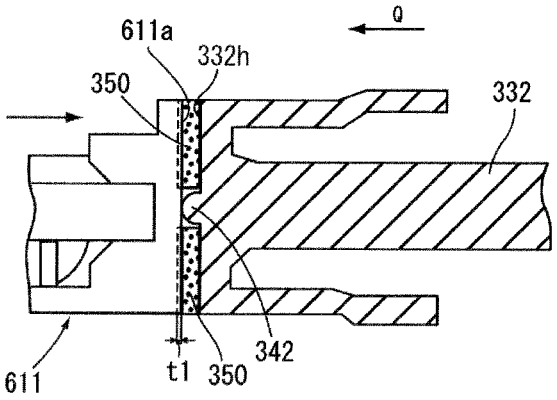
FIG. 29 is an enlarged cross-sectional diagram explaining an amount of collapse of a sealing member in another embodiment.

As shown in FIG. 29, the amount of collapse t1 of the seal member 350 is set to about from 0.1 mm to about 0.5 mm. When the amount of collapse was set to, for example, 1 mm or greater, it was observed that a large sliding load occurred, to thereby make it likely for a toner aggregate to occur between the facing surface 350*a* of the seal member 350 and the conveying nozzle end surface 611*a*. Therefore, the amount of collapse t1 is preferably 0.5 mm or less. In the present embodiment, the amount of collapse t1 is set to 0.2 mm. By minimizing the amount of compression of the seal member 350 in this way, it is possible to suppress the rotation load of the replenishing developer housing container 32 (container body 33). A toner that has deposited on the surface of the seal member 350 does receive a slight compression force. However, this toner is not sandwiched between the stiff materials, i.e., the container shutter end surface 332*h* and the end surface 611*a* of the conveying nozzle 611, but is pushed onto the end surface 611*a* of the conveying nozzle 611 by the flexible seal member 350. Therefore, it is estimated that the flexibility of the seal would absorb the pushing force to thereby reduce the sliding load to the toner.

By providing the seal member 350, it is possible to suppress the toner from entering the interfacial gap, which makes it possible to suppress occurrence of an aggregate due to the rotation of the container body 33 more securely.

Figure 28:
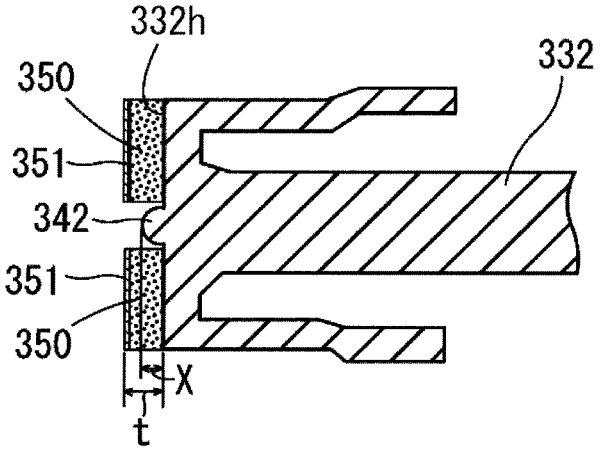
FIG. 28 is an enlarged cross-sectional diagram showing a configuration of a seal member in another embodiment.

As shown in FIG. 26, the facing surface 350*a* of the seal member 350 rotates simultaneously with the container shutter 332 while compressively contacting the conveying nozzle end surface 611*a*. Hence, a sheet material 351 made of a high molecular polyethylene sheet or a polyethylene terephthalate (PET) material may be bonded to the facing surface 350*a* of the seal member 350 as shown in FIG. 28, to thereby form the surface facing the conveying nozzle end surface 611*a* as a lowly frictional surface. By being formed as a lowly frictional surface, the facing surface 350*a* to face the conveying nozzle end surface 611*a* can suppress a load to be applied to the toner due to sliding relative to the conveying nozzle end surface 611*a*.

Figure 31:
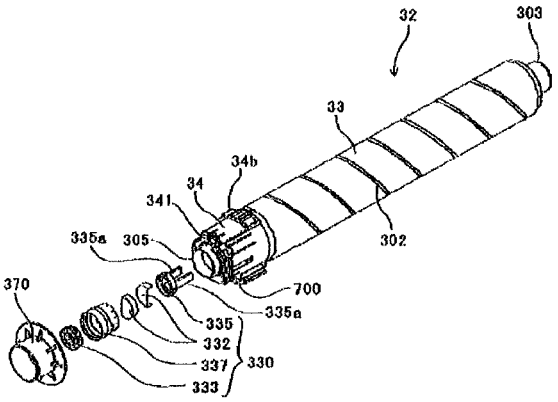
FIG. 31 is a perspective explanatory diagram showing a configuration of a replenishing developer housing container of the present invention.

In the present invention, as shown in FIG. 31, a configuration may be used other than the configuration in which the protruding portion is the shutter side surface support portion 336*a* supporting a shutter biased by the container shutter spring.

Specifically, a plurality of (in the present embodiment, two) thin film members which elastically deforms the container shutter 332 for closing the container opening portion is laminated with their positions offset with respect to one another. A laminated portion thereof elastically deforms to thereby open the container opening portion.

The laminated portion of the thin film member is flared to thereby insert the conveying nozzle into the container opening portion.

In this case, there is no shutter biased by the biasing member in the above-described embodiment.

However, a pair of members each having a flat plate shape is allowed to protrude from the container opening portion toward the container rear end side similar to the shutter side surface support portion 335*a* in the above-described embodiment. Thus, the pair of members functions as a replenishing developer passing portion configured to pass the replenishing developer from the uplifting portion to the nozzle opening.

Other configurations than those above-described are the same as other embodiments.

Thus, the shape and configuration of the protruding portion are not limited as long as effects of the present invention can be exhibited.

Figure 36:
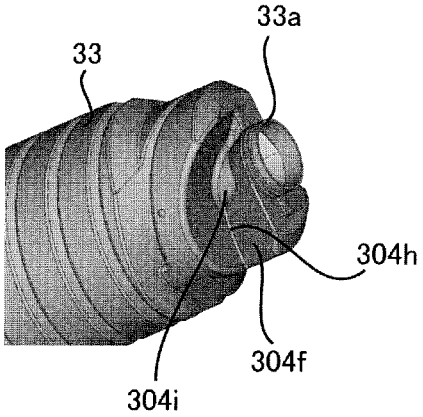
FIG. 36 is a perspective diagram showing another mode of a replenishing developer housing container of the present invention.
Figure 37:
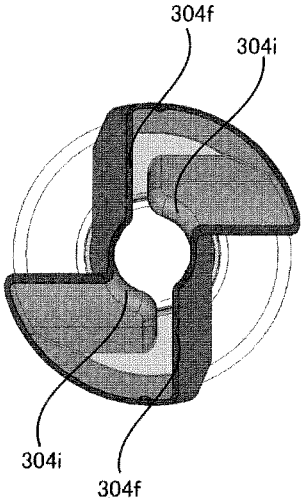
FIG. 37 is a cross-sectional diagram showing another mode of a replenishing developer housing container of the present invention.

FIG. 36 and FIG. 37 show a replenishing developer housing container, in which the container body includes a large circumference portion that adjoins the uplifting portion 304, and the curving portions 304*i* are larger than those shown in FIG. 30. Such a configuration is also possible. In FIG. 37, the container opening portion 33*a* exists at the deeper side of the drawing sheet.

Next, an example manufacturing step of filling the replenishing developer housing container 32 with a replenishing developer will be explained with reference to FIG. 38A and FIG. 38B.

First, a hole 33*d*2 (through-hole) to lead into the container body 33 is formed at the gripping portion 303 of an empty replenishing developer housing container 32 (a machining step).

After this, a cleaning nozzle is inserted from the hole 33*d*2 to clean the interior of the container body 33.

Figure 38A:
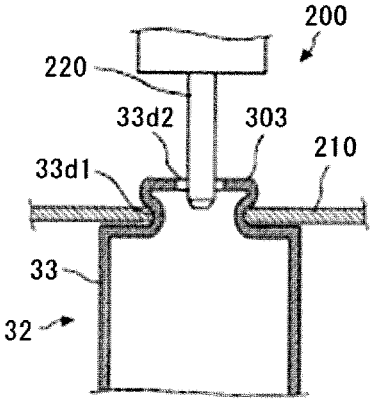
FIG. 38A is a diagram explaining an example manufacturing process for filling a replenishing developer housing container with a replenishing developer.

After this, the replenishing developer housing container 32 in which the hole 33*d*2 is formed is set on a filling machine 200 as shown in FIG. 38A.

Specifically, a constricted portion 33*d*1 of the gripping portion 303 as a hooking portion is engaged with a support portion 210 of the filling machine 200, and the replenishing developer housing container 32 is suspended such that the gripping portion 303 comes to the top.

Then, a nozzle 220 of the filling machine 200 is inserted into the hole 33*d*2 of the replenishing developer housing container 32, and the filling machine 200 fills the replenishing developer housing container 32 with the replenishing developer (a filling step).

Figure 38B:
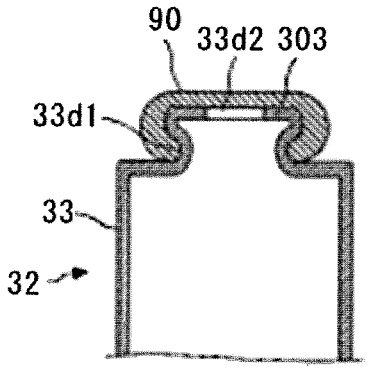
FIG. 38B is a diagram explaining an example manufacturing process for filling a replenishing developer housing container with a replenishing developer.

Then, with reference to FIG. 38B, when filling of the replenishing developer is completed, the hole 32*d*2 is sealed with a sealing cap or the like as a sealing member.

This ensures sealing property of the replenishing developer housing container 32 after filled with the replenishing developer.

In the present embodiment, a cap 90 to be placed over the gripping portion 303 is used as the sealing member. However, a plug to be inserted into the hole 33*d*2 may be used as a sealing member, or a seal member such as polyurethane foam to be placed over the hole 33*d*2 for cover may be used as a sealing member. That is, the replenishing developer housing container of the present embodiment is completed as a replenishing developer housing container having a hole opened in the container body and having this hole sealed with a sealing member.

As described above, in the present embodiment, when filling the replenishing developer housing container 32 with a replenishing developer, it is unnecessary to disassemble the nozzle receiving member 330 from the container body 33 to fill the replenishing developer housing container 32 with the replenishing developer.

This improves the work efficiency in the manufacturing process.

Next, a toner and a carrier contained in the replenishing developer and the developer in a developing device will be described.

(Carrier)

A carrier of the present invention is not particularly limited, but includes a coating material and a coating layer for coating the core material. The coating layer contains a binder resin and particles.

<Effect of Replenishing Toner and Carrier>

In order to supply a constant amount of toner without depending on a residual amount of a toner, color stability is improved.

It was confirmed that premixing a carrier with a toner in a toner bottle leads to improvement a toner discharging property.

A percentage of a carrier contained in a replenishing developer is preferably 3% by mass to 50% by mass. When the percentage is less than 3% by mass, an effect of improving a toner conveying property is difficult to be achieved. When the percentage is more than 50% by mass, toner deterioration due to a difference in specific gravity, a cost increase of a toner bottle, and a decrease of yield are caused, which is not preferred.

A bulk density of a carrier may achieve the effect of improving the toner conveying property, as long as it is higher than a bulk density of a toner. However, the bulk density of a carrier is preferably 1.7 g/cm$^3$ to 2.6 g/cm$^3$.

When the bulk density is less than 1.7 g/cm$^3$, a difference in bulk density between the carrier and the toner is decreased, so that an effect of loosening aggregates and the effect of improving the conveying property against rotation of a bottle are difficult to be achieved. When the bulk density is more than 2.6 g/cm$^3$, a difference in specific gravity between a carrier and a toner promotes embedment of an external additive in a toner bottle, which is not preferred because abnormal images such as roughness and transfer failure are caused.

A carrier preferably includes fine convexoconcaves on a surface of a coating layer. The convexoconcaves have found to improve a toner conveying property.

The fine convexoconcaves can be arbitrarily formed by dispersing particles serving as filler onto the coating layer, and are expressed as a ratio (D/h) of a particle diameter of the particles D to an average thickness of the coating layer (layer thickness) h. The D/h is preferably 0.01 to 1.0, more preferably 0.1 to 1.0. This allows for formation of fine convexoconcaves using particles on a surface of the carrier, so that an excellent toner conveying property due to the convexoconcaves can be achieved. Additionally, a carrier being excellent in wear resistance due to the presence of particles on the coating layer, and capable of excellently scraping off a toner-spent product onto the carrier by the action of the convexoconcaves can be achieved.

When the D/h is larger than 1, in the case where an image having a small image area is continuously produced, abrasion of convex portions formed with particles on the coating layer causes a decreased resistance of the carrier, resulting in deterioration of image quality. When the D/h is less than 0.01, almost no convexoconcave is formed with particles on the coating layer, that is, the coating layer has a flat surface. Therefore, a toner adherence causes a low charging performance, resulting in deterioration of image quality.

The thickness h of the coating layer is determined as follows. A cross section of the carrier is observed with a transmission electron microscope (TEM) to thereby measure thicknesses of resin portions in the coating layer coating a surface of the carrier, and the measured thickness values are averaged. Specifically, distances from surfaces of the core material to surfaces of the coating layers are measured at any 50 points at the cross-section of the carrier. The resultant measured values are averaged, which is determined as the thickness h (μm).

The particle diameter D of the particle can be determined from an average particle diameter as measured by a centrifugal sedimentation method. Here, a distance from a center of gravity of the particle is determined as the particle diameter.

In a carrier of the present invention, a ratio (hereinafter referred to as a coverage of particles) of a product of the cross-section area of the particles and the number thereof to a product of the surface area of the core material and the number thereof is preferably from 0.3 to 30. This allows the particles to be moderately stacked within the coating layer to thereby strengthen the coating layer. As a result, the coating layer is less exfoliated from the core material and is less abraded, and the carrier can maintain a stable quality, even after printing for a long period of time. When the coverage of the particles is less than 0.3, an effect of preventing toner adherence by the action of convexoconcave of the particles is deteriorated. When the coverage of the particles is greater than 30, a content of the binder resin is decreased to thereby deteriorate chargeability. In addition, the binder resin may hold the particles insufficiently.

The coverage of the particles is determined by the following equation:

$$\text{Coverage}=(Da\times\rho s\times W)/(4\times Df\times\rho f)\times 100$$

where Ds denotes a particle diameter of the core material of the carrier, ρs denotes an absolute specific gravity of the core material of the carrier, W denotes an added amount of the particles (electroconductive particles and inorganic oxidized particles) to that of the core material of the carrier, Df denotes a particle diameter of the particles (electroconductive particles and inorganic oxidized particles), and ρf denotes an absolute specific gravity of electroconductive particles and inorganic oxidized particles.

A surface area of the core material is calculated from a primary particle diameter of the core material, and a cross-section of the particle is calculated from an average particle diameter measured by a centrifugal sedimentation method.

Coverage of a presence (A) is determined by changing W in the above equation as follows.

$$W(A)=W\times(\text{the number of } A \text{ per unit cross section/the number of particles per unit area})$$

Note that, the number of A is determined as the number when a cross section of the carrier is observed by means of a transmission electron microscope, and particles at random sites on randomly selected 10 particles are actually counted until 1,000 particles are counted.

The average particle diameter (D) of particles in the coating layer is measured as follows. A juicer-mixer is charged with 30 mL of amino silane (SH6020, manufactured by Dow Corning Toray Silicone Co., Ltd.) and 300 mL of a toluene solution. Then, 6.0 g of a sample is added thereto. The resultant mixture is dispersed in the mixer at a low rotation speed for 3 min to thereby prepare a dispersion liquid. The dispersion is diluted by adding the dispersion in an appropriate amount to 500 mL of a toluene solution which had been contained in a 1,000 mL beaker to thereby obtain a dilution liquid. The dilution liquid is constantly stirred by means of a homogenizer. The volume-average particle diameter of the sample is measured by an ultracentrifugal automatic particle size distribution meter (CAPA-700, manufactured by Horiba, Ltd.).

(Measurement Conditions)

Rotation speed: 2,000 rpm

Maximum particle size: 2.0 μm

Minimum particle size: 0.1 μm

Particle size interval: 0.1 μm

Dispersion medium viscosity: 0.59 mPa·s

Dispersion medium density: 0.87 g/cm$^3$

Particle density: an absolute specific gravity measured by a dry automatic bulk density meter (ACUPIC 1330, manufactured by Shimadzu Corporation) was input as the density of the inorganic particles.

(Core Material)

In a carrier of the present invention, a core material is not particularly limited as long as it is known. Examples thereof include ferrite, Cu—Zn ferrite, Mn ferrite, Mn—Mg ferrite, Mn—MG—Sr ferrite, magnetite, iron, and nickel. The core material can be appropriately selected in accordance with application and intended purpose of the carrier. For example, MFL-35S (manufactured by POWDERTECH CO., LTD.), MFL-35HS (manufactured by POWDERTECH CO., LTD.), or DFC-400M (manufactured by DOWA IRON POWDER CO., LTD.) may be used, but the core material is not limited thereto. The core material preferably has an average particle diameter of from 20 μm to 65 μm. When the average particle diameter is less than 20 μm, the carrier tends to adhere to an electrostatic latent image bearing member. When the average particle diameter is larger than 65 μm, deterioration of image quality such as a carrier stripe tends to occur.

In a carrier of the present invention, a ratio of a weight of the particles to that of a total weight of the binder resin and the particles in the coating layer is preferably from 10% by mass to 80% by mass, more preferably from 40% by mass to 70% by mass. When the amount is less than 10% by mass, a rate of the particles on a surface of the carrier is low, so that an effect of alleviating contact with the binder resin associated with a strong impact is decreased. When the amount is greater than 80% by mass, a content of the binder resin is decreased to thereby deteriorate chargeability. In addition, the binder resin may hold the particles insufficiently.

A content of the particles (% by mass) can be determined according to the following equation.

$$\text{Content of particles(\% by mass)}=[\text{Weight of particles/(Total amount of particles and solid content of binder resin)}]$$

A carrier of the present invention preferably has a volume resistivity of from $1\times10^{10}$ Ω·cm to $1\times10^{17}$ Ω·cm. When the volume resistivity is less than $1\times10^{10}$ Ω·cm, the carrier tends to adhere to non-image areas. When the volume resistivity is greater than $1\times10^{17}$ Ω·cm, the edge effect deteriorates. When the volume resistivity is below the lower measurable limit by a high resistance meter, the carrier substantially has no volume resistivity and is considered to be broken down.

The volume resistivity is measured as follows. A carrier is filled into a cell which is a container formed of a fluororesin and in which two electrodes having a surface area of 2 cm×4 cm respectively and a gap therebetween of 2 mm are contained. The cell is tapped by a tapping machine (PTM-1, manufactured by SANKYO PIO-TECH. CO., Ltd.) at 30 times/min for 1 min. A DC voltage of 1,000 V is applied to between the electrodes. A DC resistance is measured by a high resistance meter 4329A (4329A+LJK5HVLVWDQFH0HWHU, manufactured by YOKOKAWA HEWLETT PACKARD LTD) to thereby determine an electric resistance R Ω·cm, from which Log R is calculated.

In the present invention, particles are not particularly limited. Examples thereof include inorganic particles such as zinc and valium. Among them, alumina, silica, titanium, barium, tin, and carbon is preferably contained.

The powder specific resistance of the particles is preferably −3 Log (Ω·cm) to 3 Log (Ω·cm).

In a carrier of the present invention, the coating layer preferably has an average thickness (layer thickness) of from 0.05 μm to 4.00 μm, more preferably from 0.05 μm to 2.00 μm, most preferably 0.05 μm to 1.00 μm. When the average thickness is less than 0.05 μm, the coating layer covering convex portions formed of the particles has insufficiently average thickness, so that the concave portions are abraded or the core material is exposed, leading to a decrease of resistance. When the average thickness is thicker than 4.00 μm, charging performance is deteriorated and image definition tends to deteriorate due to upsizing of the carrier.

In a carrier of the present invention, the binder resin preferably has a glass transition temperature of 20° C. to 100° C. This is why the binder resin has a suitable elasticity and an impact due to contact of the carrier with a toner or each other during stirring the developer in order to frictionally charge it can be absorbed. As a result, abrasion of the coating layer can be suppressed. When the glass transition temperature is lower than 20° C., blocking tends to occur. When the glass transition temperature is higher than 100° C., the binder resin deteriorates in capability of absorbing impact and tends to be abraded.

The glass transition temperature is specifically determined by as follows. TA-60WS and DSC-60 (manufactured by Shimadzu Corporation) are used to measure the glass transition temperature under the following conditions.

(Measurement Conditions)

Sample container: Sample pan made of aluminum (with a lid)

Sample amount: 5 mg

Reference: Sample pan made of aluminum (10 mg of alumina)

Atmosphere: Nitrogen (flow rate: 50 mL/min)

Temperature Conditions

Starting temperature: 20° C.

Heating speed: 10° C./min

End temperature: 150° C.

Holding time: none

Cooling speed: 10° C./min

End temperature: 20° C.

Holding time: none

Heating speed: 10° C./min

End temperature: 150° C.

The measurement results are analyzed using a data analysis software (TA-60 version 1.52, manufactured by Shimadzu Corporation). A range of ±5° C. is specified so as to have, as a center, a point showing a maximum peak point on the lowest temperature side of a DSC differential curve in the second heating, to thereby determine a peak temperature using a peak analysis function of the analysis software. Next, the maximum endothermic temperature of the DCS curve is determined using the peak analysis function of the analysis software in the range of +5° C. and −5° C. of the peak temperature on the DCS curve. This corresponds to the Tg of the sample.

A carrier of the present invention preferably has a weight average particle diameter of 20 μm to 65 μm. When the weight average particle diameter is less than 20 μm, particles deteriorate in uniformity and the carrier adherence is likely to occur. When the weight average particle diameter is larger than 65 μm, reproducibility of image details deteriorates and high-definition images are difficult to be produced. Note that, the weight average particle diameter of a carrier can be measured by SRA type of MICROTRAC particle size analyzer (manufactured by from NIKKISO CO., LTD.). Here, a particle size range is set to 0.7 μm to 125 μm, methanol is used as a dispersion liquid, and refractive indexes of the carrier and the core material are set to 1.33 and 2.42, respectively.

In a carrier of the present invention, the binder resin preferably contains a silicone resin. The silicone resin has a low surface energy, so that the silicone resin can prevent toner adherence.

The silicone resin may be any known silicone resins. Examples thereof include a straight silicone resin containing only organosiloxane bonds, silicone resins modified with a resin such as an alkyd resin, a polyester resin, an epoxy resin, an acrylic resin, and a urethane resin. Examples of commercially available products of the straight silicone resin include KR271, KR255 and KR152 (all manufactured by Shin-Etsu Chemical Co., Ltd) and SR2400, SR2406 and SR2410 (all manufactured by Dow Corning Toray Silicone Co., Ltd). The straight silicone resins may be used alone, or in combination with other components for cross-linking therewith or for controlling a charge amount. Examples of the modified silicones include KR206 (alkyd-modified), KR5208 (acrylic-modified), ES1001N (epoxy-modified) and KR305 (urethane-modified) (all manufactured by Shin-Etsu Chemical Co., Ltd) and SR2115 (epoxy-modified) and SR2110 (alkyd-modified) (all manufactured by Dow Corning Toray Silicone Co., Ltd).

In a carrier of the present invention, the binder resin preferably contains an acrylic resin. The acrylic resin has strong adhesiveness and low brittleness, so that the coating layer is less likely to be abraded or exfoliated to thereby be stably maintained. Further, the particles contained in the coating layer can be robustly held, which is particularly effective in the case where particles having a particle diameter larger than the average thickness (layer thickness) of the coating layer are to be held.

The acrylic resin may be any known acrylic resins and is not particularly limited. The acrylic resin may be used alone or in combination with other components for cross-linking therewith. Examples of the other components include amino resins such as guanamine and a melamine resin; and acidic catalysts. The acidic catalysts are not particularly limited, as long as it has catalysis. Examples of the acidic catalysts include those having a reactive functional group such as a fully alkylated group, a methylol group, an imino group, and a methylol/imino group.

In the present invention, the binder resin preferably contains an acrylic resin and a silicone resin. The acrylic resin has a high surface energy, so that accumulation of adhered toner may cause failures such as a decrease of a charge amount in the case where a toner which is tends to adhere. This problem can be solved by using the silicone resin having a low surface energy in combination. However, the silicone resin has a low adhesiveness and high brittleness. Therefore, it is important to use a well-balanced combination of the two resins. This prevents the toner to adhere and allows for a coating layer being excellent in wear resistance.

In a carrier of the present invention, a ratio of a weight of the binder resin to a total weight of the binder resin and the core material is preferably from 0.1% by mass to 1.5% by mass. When the ratio is less than 0.1% by mass, the coating layer does not sufficiently work. When the ratio is greater than 1.5% by mass, the coating layer is more abraded.

A carrier of the present invention preferably has a magnetization at 1 kOe of 40 $Am^2/kg$ to 90 $Am^2/kg$. This keeps appropriate holding power between carrier particles, so that a toner is easily dispersed into the carrier in a developer. When the magnetization at 1 kOe is less than 40 $Am^2/kg$, the carrier adherence tends to occur. When the magnetization at 1 kOe is greater than 90 $Am^2/kg$, an ear (magnetic brush) of the developer formed upon developing becomes hard, resulting in deterioration of reproducibility of image details. Therefore, high-definition image is difficult to be produced.

The magnetic moment can be measured as follows. A cylindrical cell (inner diameter: 7 mm, height: 10 mm) is filled with 1.0 g of the carrier core material, and set in a B-H tracer (BHU-60, manufactured by Riken Denshi Co., Ltd.). A first magnetic field is gradually increased to 3,000 oersteds and gradually decreased to 0. Then, increasing an opposite magnetic field is gradually increased to 3,000 oersteds and gradually decreased to 0. Thereafter, a magnetic field having the same direction as the first magnetic field is applied to prepare a B-H curve, from which the magnetic moment at 1,000 oersteds is calculated.

In the present embodiment, the carrier described above in detail is contained in a developer housing container. In an image forming apparatus, a replenishing developer containing the carrier is replenished from inside of the developer housing container into a developer accommodating section.

The toner and the carrier replenished in the developer accommodating section are mixed with a toner and a carrier which has initially contained therein by means of a conveying screw. At that time, the carrier is brought into contact with the toner, or with each other, leading to friction therebetween. The friction tends to let a surface of the carrier to be scraped.

The carrier contained in the replenishing developer includes convexoconcaves on a surface of the coating layer. The convexoconcaves are resulted from particles dispersed in the coating layer. Therefore, even when the toner or other carrier particles in brought into contact with the coating layer during stirring and mixing, the convex portions cushion the shock. Accordingly, the surface of the carrier is greatly prevented from scraping. In addition, a spent component of the toner adhered to the surface of the carrier is scarped off with the convex portions, which prevents the toner spent to occur. Therefore, the developer in the developer accommodating section can exhibit more stable charge controlling effect. The developer container readily contains the same carrier as that of the replenishing developer before fed therein from the developer storage. The presence of convexoconcaves having such function at a constant level allows the carrier to exhibit an expected function.

In the developing device, most of degraded carriers are discharged by the developer discharging device. However, the degraded carriers partially remain in the developer accommodating section for a long period of time. When only a small amount of the toner is consumed in the image forming apparatus, only a small amount of the carrier is exchanged in the developer accommodating section and the carrier remains in the developer accommodating section longer.

In the present embodiment, before the replenishing developer in the developer accommodating section is replenished, the developer in a developing device contained in the developer accommodation section contains a carrier and a toner which are the same as the carrier and the toner contained in the replenishing developer.

Therefore, even when only a small amount of the developer is exchanged, or even when the carrier initially contained in the developer accommodating section partially remain therein without being discharged therefrom, the carrier is prevented from degrading in the developer accommodating section by the action of the mechanism similar to those described above. Additionally, even after use for a long period of time, the developer can maintain a stable charging property.

(Toner)

A toner contained in a replenishing developer and a developer in a developing device includes a binder resin and a colorant; and, if necessary, further includes a releasing agent, a charge controlling agent, and other components.

A method for producing the toner is not particularly limited and may be appropriately selected depending on the intended purpose. Examples thereof include a pulverization method, and a suspension polymerization method, an emulsion polymerization method or a polymer suspension method, in which an oil phase is emulsified, suspended or aggregated in an aqueous medium to form toner base particles.

(Binder Resin)

The binder resin is not particularly limited and may be appropriately selected from known binder resins depending on the intended purpose. Examples thereof include homopolymers of styrene or substituted products of styrene, such as polystyrene, poly-p-styrene and polyvinyltoluene; styrene copolymers, such as styrene-p-chloroetyrene copolymers, styrene-propylene copolymers, styrene-vinyltoluene copolymers, styrene-methyl acrylate copolymers, styrene-ethyl acrylate copolymers, styrene-methacrylate copolymers, styrene-methyl methacrylate copolymers, styrene-ethyl methacrylate copolymers, styrene-butyl methacrylate copolymers, styrene-α-methyl chloromethacrylate copolymers, styrene-acrylonitrile copolymers, styrene-vinyl methyl ether copolymers, styrene-vinyl methyl ketone copolymers, styrene-butadiene copolymers, styrene-isopropyl copolymers and styrene-maleic ester copolymers; polymethyl methacrylate resins; polybutyl methacrylate resins; polyvinyl chloride resins; polyvinyl acetate resins; polyethylene resins; polyester resins; polyurethane resins; epoxy resins; polyvinyl butyral resins; polyacrylic resins; rosin resins; modified rosin resins; terpene resins; phenol resins; aliphatic or aromatic hydrocarbon resins; and aromatic petroleum resins. These may be used alone or in combination.

(Colorant)

The colorant is not particularly limited and may be appropriately selected from known dyes and pigments depending on the intended purpose. Examples include carbon black, nigrosine dye, black iron oxide, naphthol yellow S, hansa yellow (10G, 5G and G), cadmium yellow, yellow iron oxide, ocher, chrome yellow, titanium yellow, polyazo yellow, oil yellow, hansa yellow (GR, A, RN and R), pigment yellow L, benzidine yellow (G and GR), permanent yellow (NCG), vulcan fast yellow (5G and R), tartrazine lake, quinoline yellow lake, anthrazane yellow BGL, isoindolinone yellow, red iron oxide, red lead, vermilion lead, cadmium red, cadmium mercury red, antimony vermilion, permanent red 4R, para red, fire red, p-chloro-o-nitroaniline red, lithol fast scarlet G, brilliant fast scarlet, brilliant carmine BS, permanent red (F2R, F4R, FRL, FRLL and F4RH), fast scarlet VD, vulcan fast rubine B, brilliant scarlet G, lithol rubine GX, permanent red F5R, brilliant carmine 6B, pigment scarlet 3B, bordeaux 5B, toluidine maroon, permanent bordeaux F2K, hello bordeaux BL, bordeaux 10B, BON maroon light. BON maroon medium, eosin lake, rhodamine lake B, rhodamine lake Y, alizarine lake, thioindigo red B, thioindigo maroon, oil red, quinacridone red, pyrazolone red, polyazo red, chrome vermilion, benzidine orange, perynone orange, oil orange, cobalt blue, cerulean blue, alkali blue lake, peacock blue lake, victoria blue lake, metal-free phthalocyanine blue, phthalocyanine blue, fast sky blue, indanthrene blue (RS and BC), indigo, ultramarine, prussian blue, anthraquinone blue, fast violet B, methyl violet lake, cobalt violet, manganese violet, dioxane violet, anthraquinone violet, chrome green, zinc green, chromium oxide, viridian, emerald green, pigment green B, naphthol green B, green gold, acid green lake, malachite green lake, phthalocyanine green, anthraquinone green, titanium oxide, zinc white and lithopone.

These may be used alone or in combination.

An amount of the colorant contained in a toner is preferably 1% by mass to 15% by mass, more preferably in an amount of 3% by mass to 10% by mass.

The colorant may be combined with a resin to form a masterbatch. The resin is not particularly limited and may be appropriately selected from known resins depending on the intended purpose. Examples thereof include polymers of styrene or substituted products thereof, styrene copolymers, polymethyl methacrylate resins, polybutyl methacrylate resins, polyvinyl chloride resins, polyvinyl acetate resins, polyethylene resins, polypropylene resins, polyester resins, epoxy resins, epoxy polyol resins, polyurethane, polyamide, polyvinyl butyral, polyacrylic resins, rosins, modified rosins, terpene resins, aliphatic hydrocarbon resins, alicyclic hydrocarbon resins, aromatic petroleum resins, chlorinated paraffin, and paraffin. These may be used alone or in combination.

(Releasing Agent)

The releasing agent is not particularly limited and may be appropriately selected from known releasing agents depending on the intended purpose. Example thereof includes waxes.

Examples of the waxes include carbonyl group-containing waxes, polyolefin waxes, and long-chain hydrocarbons. These may be used alone or in combination. Among them, carbonyl group-containing waxes are preferred.

Examples of the carbonyl group-containing wax include polyalkanoic acid esters, polyalkanol esters, polyalkanoic acid amides, polyalkyl amides, and dialkyl ketones. Examples of the polyalkanoic acid ester include carnauba wax, montan wax, trimethylolpropane tribehenate, pentaerythritol tetrabehenate, pentaerythritol diacetate dibehenate, glycerin tribehenate, and 1,18-octadecanediol distearate. Examples of the polyalkanol ester include tristearyl trimellitate, and distearyl maleate. Examples of the polyalkanoic acid amide include dibehenyl amide. Examples of the polyalkyl amide include tristearyl amide trimellitate. Examples of the dialkyl ketone include distearyl ketone. Among these carbonyl group-containing waxes, polyalkanoic acid esters are particularly preferred.

Examples of the polyolefin wax include polyethylene waxes and polypropylene waxes.

Examples of the long-chain hydrocarbon include paraffin waxes and Sasol wax.

The melting point of the releasing agent is not particularly limited and may be appropriately selected depending on the intended purpose. However, it is preferably 40° C. to 160° C., more preferably 50° C. to 120° C., particularly preferably 60° C. to 90° C.

When the melting point is less than 40° C., the waxes may adversely affect the heat resistant storageability. When the melting point is above 160° C., cold offset tends to occur during fixing at a low temperature.

The releasing agent preferably has a melt viscosity of 5 cps to 1,000 cps, more preferably of 10 cps to 100 cps as measured at a temperature which is 20° C. higher than the melting point of the wax. When the melt viscosity is less than 5 cps, releasability may be deteriorated. When the melt viscosity is greater than 1,000 cps, effects of improving anti-hot offset property or low-temperature fixability may fail to achieve.

An amount of the releasing agent contained in the toner is not particularly limited and may be appropriately selected depending on the intended purpose. However, it is preferably 1% by mass to 40% by mass, more preferably 3% by mass to 30% by mass.

When the amount is greater than 40% by mass, the flowability of the toner may be undesirably decreased.

(Charge-Controlling Agent)

The charge-controlling agent is not particularly limited and may be appropriately selected from positive or negative charge-controlling agent depending on whether a photoconductor is charged positively or negatively.

The negative charge-controlling agent may be a resin or a compound having an electron-donating functional group, an azo dye, or a metal complex of an organic acid. Specific examples thereof include BONTRON (Product Nos: S-31, S-32, S-34, S-36, S-37, S-39, S-40, S-44, E-81, E-82, E-84, E-86, E-88, A, 1-A, 2-A, and 3-A) (all manufactured by Orient Chemical Industries Ltd.); KAYACHARGE (Product Nos: N-1, and N-2) and KAYASET BLACK (Product Nos: T-2, and 004) (all manufactured by Nippon Kayaku Co., Ltd.); AIZEN SPILON BLACK (T-37, T-77, T-95, TRH, and TNS-2) (all manufactured by Hodogaya Chemical Co., Ltd.); and FCA-1001-N, FCA-1001-NB and FCA-1001-NZ (all manufactured by Fujikura Kasei Co., Ltd.).

The positive charge-controlling agent may be a basic compound such as nigrosine dye, a cationic compound such as quaternary ammonium salt, or a metal salt of a higher fatty acid. Specific examples thereof include BONTRON (Product Nos: N-01, N-02. N-03, N-04, N-05, N-07, N-09, N-10, N-11, N-13, P-51. P-52, and AFP-B) (all manufactured by Orient Chemical Industries Ltd.); TP-302, TP-415 and TP-4040 (all manufactured by Hodogaya Chemical Co., Ltd.); COPY BLUE PR and COPY CHARGE (Product Nos: PX-VP-435, and NX-VP-434) (all manufactured by Hoechst AG); FCA (product Nos: 201, 201-B-1, 201-B-2, 201-B-3, 201-PB, 201-PZ, and 301) (all manufactured by Fujikura Kasei Co., Ltd.); and PLZ (Product Nos: 1001, 2001, 6001, and 7001) (all manufactured by Shikoku Chemicals Corporation).

These may used alone or in combination.

There is no particular restriction on the amount of the charge controlling agent and any content can be selected depending on, such as, types of a binding resin and a toner producing method which includes a dispersion method.

The amount of the charge-controlling agent is determined depending on different factors such as, types of a binding resin and a toner producing method which includes a dispersion method, and thus is not limited to a particular amount. However, the amount is preferably 0.1 parts by mass to 10 parts by mass, more preferably 0.2 parts by mass to 5 parts by mass, relative to 100 parts by mass of the binder resin. When the amount is above 10 parts by mass, the chargeability of a toner may be excessively large to reduce an effect of the charge controlling agent, thus resulting in an increased electrostatic attraction force to a developing roller, thereby reducing flowability of a developer and image density. Where the amount is less than 0.1 parts by mass, charging may start poorly to result in insufficient charge amount, which may easily affect a toner image.

In addition to the binder resin, releasing agent, colorant, and charge-controlling agent, the toner material may also contain inorganic particles, a flowability improving agent, a cleaning improving agent, a magnetic material, and a metal soap, if necessary.

Examples of the inorganic particle include silica, titania, alumina, cerium oxide, strontium titanate, calcium carbonate, magnesium carbonate, or calcium phosphate. Among them, more preferred are silica particles hydrophobized with silicone oil or hexamethyldisilazane and surface-treated titanium oxide.

Examples of the silica particles include AEROSIL (Product Nos: 130, 200V, 200CF, 300, 300CF, 380, OX50, TT600, MOX80, MOX170, COK84, RX200, RY200, R972, R974, R976, R805, R811, R812, T805, R202, VT222, RX170, RXC, RA200, RA200H, RA200HS, RM50, RY200, and REA200) (all manufactured by Nippon Aerosil Co. Ltd.); HDK (Product Nos: H20, H2000, H3004, H2000/4, H2050EP, H2015EP, H30500EP, and KHD50) and HVK2150 (all manufactured by Wacker Chemie GmbH); and CAB-O-SIL (Product Nos: L-90, LM-130, LM-150, M-5, PTG, MS-55, H-5, HS-5, EH-5, LM-150D. M-7D, MS-75D, TS-720, TS-610, and TS-530) (all manufactured by Cabot Corporation).

An amount of the inorganic particles is preferably 0.1 parts by mass to 5.0 parts by mass, more preferably 0.5 parts by mass to 3.2 parts by mass, relative to 100 parts by mass of the toner base particles.

A method for producing a toner of the present invention is not particularly limited as described above, but the following method will be exemplified as a pulverization method.

The above-described toner materials are mixed. The resultant mixture is placed into a melt kneader, followed by melting and kneading. The melt kneader may be a single-screw continuous kneader, a twin-screw continuous kneader, or a batch kneader using a roll mill. Suitable examples of the melt kneader include a twin-screw extruder model KTK (manufactured by Kobe Steel Ltd.), an extruder model TEM (manufactured by Toshiba Machine Co., Ltd.), a twin-screw extruder (manufactured by KCK Co., Ltd.), a twin-screw extruder model PCM (manufactured by Ikegai Corp.) and Ko-Kneader (manufactured by Buss AG). Preferably, the melting and kneading are carried out proper conditions so as not to cause cleavage of molecular chains of a binding resin. Specifically, the melting and kneading are carried out at a temperature determined based on the softening point of the binder resin. When the temperature is excessively higher than the softening point, the molecular chains are excessively cleaved. When the temperature is excessively low, dispersion may not proceed.

In the pulverization, the kneaded product is pulverized. In this process, it is preferred that the kneaded product is pulverized first coarsely and then finely. Here, the kneaded product is preferably pulverized by forcing it to collide against a collision plate in a jet stream, by forcing the particles to collide each other in a jet stream, or by pulverizing the product in a narrow gap between a mechanically rotating rotor and a stator.

In the classification, the pulverized product is classified to thereby obtain particles with a predetermined particle diameter. This can be done, for example, by removing the fine particle fraction by a cyclone, decanter, or centrifugation.

After the pulverization and classification are completed, the pulverized product is further classified, for example, by applying a centrifugal force in an air stream, to thereby produce toner having a predetermined particle diameter.

To improve flowability, storageability, developability, and transferability of toner, additives such as inorganic particles (e.g., hydrophobic silica powder) may further be added to and mixed with the toner base particles produced in the above-described manner. The mixing is performed by means of a common powder mixer. However, it is preferred that the mixer is equipped with a jacket to control the internal temperature thereof. Note that, in order to change the load history applied to the additives, the additives may be added either halfway through or gradually. In this case, the number of rotation, rolling speed, time, and temperature of the mixer may be varied. A large load may be applied initially, followed by a relatively small load, or vise versa. Examples of the mixer that can be used for this purpose include a V-type mixer, rocking mixer, Loedige mixer, Nauta mixer and Henschel mixer. Subsequently, the mixture is allowed to pass through a sieve to remove coarse particles and aggregated particles, resulting in a toner In the present embodiment, use of a developer containing the above-described carrier and toner as a replenishing developer and a developer in a developing device prevents a surface of the carrier from being scraped and toner spent on from occurring the surface of the carrier even after use for a long period of time, so that a charge amount of the developer and electrical resistance of the carrier are suppressed from being decreased in the developer housing container to thereby achieve a stable developing property.

In the carrier, resistance of the carrier is prevented from being greatly decreased and a low-resistance region is prevented from locally occurred on a surface of the carrier. Therefore, deposition of the carrier is greatly suppressed on a solid image portion.

Accordingly, failures such as deterioration of image quality and durability which are caused by a decrease of image definition due to the carrier deposition on an image and a decrease of a developer amount in the developer housing container (14) are effectively prevented from occurring. Therefore, in a temporal use, a good image quality can be kept over a long period of time.

Also, the carrier used in the present embodiment does not contain carbon black which contributes to a color smear, and has a controlled resistance. Therefore, the carrier can provide a high-quality color image having high color reproducibility and high definition without causing a color smear on the image while keeping a stable chargeability even when the carrier is used in a color image forming apparatus.

Note that, a configuration of an image forming apparatus used in the present invention is not limited to the above-described configuration described in the present embodiment. Image forming apparatuses including other configurations can also be used as long as they have similar functions.

EXAMPLES

The present invention now will be further described with reference to Examples, but is not limited thereto. Note that, in the following Examples, "part(s)" means "part(s) by mass" and "%" means "% by mass."

<Core Material Production Example A>

$MnCO_3$, $Mg(OH)_2$, and $Fe_2O_3$ powder were each weighed and mixed together to thereby obtain mixed powder.

The mixed powder was calcined in a furnace at 900° C. for 3 hours under an air atmosphere to thereby obtain a calcine. The resultant calcine was cooled and then pulverized to powder having a particle diameter of approximately 1 μm.

The powder was added to water along with 1% by mass of a dispersing agent to thereby form slurry. The slurry was fed into a spray drier to granulate to thereby obtain granules having an average particle diameter of about 40 μm.

The granules were loaded into a furnace, followed by baking at 1,250° C. for 5 hours under a nitrogen atmosphere.

The resultant baked product was crushed with a crushing machine, followed by adjusting a particle size thereof through sieving to thereby obtain spherical ferrite particles having a volume average particle diameter of about 35 μm.

The granules were subjected to a component analysis, and found to contain 46.2 mol % of MnO, 0.7 mol % of MgO, and 53 mol % of $Fe_2O_3$.

The granules were also found to have SF-1 of 130, SF-2 of 128, and Ra of 0.45 μm.

<Core Material Production Example B>

$MnCO_3$, $Mg(OH)_2$, $Fe_2O_3$, and $SrCO_3$ powder were each weighed and mixed together to thereby obtain mixed powder.

The mixed powder was calcined in a furnace at 850° C. for 1 hour under an air atmosphere to thereby obtain a calcine. The resultant calcine was cooled and then pulverized to powder having a particle diameter of 3 μm or less.

The powder was added to water along with 1% by mass of a dispersing agent to thereby form slurry. The slurry was fed into a spray drier to granulate to thereby obtain granules having an average particle diameter of about 40 μm.

The granules were loaded into a furnace, followed by baking at 1,120° C. for 4 hours under a nitrogen atmosphere.

The resultant baked product was cracked with a cracking machine, followed by adjusting a particle size thereof through sieving to thereby obtain spherical ferrite particles having a volume average particle diameter of about 35 μm.

The granules were subjected to a component analysis, and found to contain 40.0 mol % of MnO, 10.0 mol % of MgO, 50 mol % of $Fe_2O_3$, and 0.4 mol % of SrO.

The granules were also found to have SF-1 of 145, SF-2 of 155, and Ra of 0.85 μm.

<Core Material Production Example C>

To a four-neck flask, were added 50 g of phenol, 75 g of 37% formalin, 320 g of spherical magnetite (average particle diameter: 0.24 μm), 80 g of granular hematite particles (average particle diameter: 0.40 μm), 1.0 g of calcium fluoride, 15 g of 28% aqueous ammonia, and 50 g of water to thereby obtain a mixture. The mixture was heated to 85° C. for 40 min with stirring and mixing, and maintained at the same temperature to thereby allow to react and cure for 180 min.

Then, the resultant was cooled to 30° C. and 0.5 liters of water was added thereto. Thereafter, the resultant supernatant was removed, and the resultant precipitate was washed with water and air-dried.

Then, the air-dried product was dried at 50° C. to 60° C. under a reduced pressure (5 mmHg or less) to thereby obtain a spherical composite particle powder C in which spherical magnetite particles were bound to spherical hematite particles using a phenolic resin as a binder.

The resultant spherical composite particle powder C was found to have an average particle diameter of 40.1 μm, and to have an almost spherical shape.

An amount of non-magnetic metal oxide particles contained in the spherical composite particle powder C was calculated from measurements of magnetization value and specific gravity, and found to be 19.9% by mass relative to a total amount of ferromagnetic iron compound particles and non-magnetic metal oxide particles.

Bulk density AD ($g/cm^3$), SF-1, SF-2, and Ra of each of thus obtained core materials A to C are summarized in the following Tables 1-1 and 1-2.

TABLE 1-1

| Type of core material | AD ($g/cm^3$) | SF-1 | SF-2 | Ra |
|---|---|---|---|---|
| Core material A | 2.4 | 125 | 119 | 0.45 |
| Core material B | 2.0 | 145 | 155.0 | 0.85 |
| Core material C | 1.7 | 122 | 119.0 | 0.30 |

TABLE 1-2

| Type of filler | Primary particle diameter (nm) |
|---|---|
| Filler A | 480 |
| Filler B | 200 |
| Filler C | 30 |

Examples 1 to 11 and Comparative Example 1

Firstly, 425 parts by mass of a 20% by mass silicone resin solution (SR2410, manufactured by Dow Corning Toray Co., Ltd.), 0.858 parts by mass of amino silane (SH6020, manufactured by Dow Corning Toray Co., Ltd.), 85.4 parts by mass of alumina (filler A, average particle diameter D: 0.3 μm) serving as non-electroconductive particles, and 300 parts by mass of toluene were dispersed by HOMOMIXER for 15 min to thereby obtain a coating layer forming solution.

The coating layer forming solution was applied to a surface of a core material, i.e., Core material A (baked ferrite powder, weight average particle diameter: 35 μm) by SPIRA COATER (manufactured by OKADA SEIKO CO., LTD., internal temperature: 40° C.) so as to give an average thickness h of the coating layer of 0.5 μm, followed by drying.

The resultant carrier was baked by leaving to stand in an electric furnace for 1 hour at 300° C. After cooling the carrier, the carrier was crushed using a sieve having an opening size of 63 μm, to thereby obtain a carrier containing 50% by mass of alumina, and having the D/h of 0.6, the volume resistivity of $10^{14.2}$ Ω·cm, and magnetization of 68 $Am^2/kg$.

The thickness of the coating layer h and the average particle diameter of the particles D were measured as stated above.

An average difference in height between convex portions and concave portions was determined by observing a the cross-section of the carrier with a transmission electron microscope (TEM) to thereby measure a thickness of a resin portion in the coating layer coating a surface of the carrier. Specifically, a distance from surface of the core material to surface of the coating layer at each of any 50 points on the cross-section of the carrier was measured. A difference between an average value of the largest 5 measurement values and an average value of the smallest 5 measurement values was determined as the average difference.

[Production of Toner]

(Synthetic Example of Binder Resin 1)

A reaction tank equipped with a cooling pipe, a stirrer, and a nitrogen introducing pipe was charged with bisphenol A-ethylene oxide 2 mol adduct (724 parts), isophthalic acid (276 parts), and dibutyltin oxide (2 parts), and they were reacted at 230° C. at normal pressure for 8 hours. Next, they were reacted at reduced pressure of from 10 mmHg to 15 mmHg for 5 hours, and then cooled to 160° C. Phthalic anhydride (32 parts) was added thereto, and they were reacted for 2 hours. Then, they were cooled to 80° C., and were reacted with isophorone diisocyanate (188 parts) for 2 hours to thereby obtain an isocyanate-containing prepolymer (P1).

Then, the prepolymer (P1) (267 parts) were reacted with isophorone diamine (14 parts) at 50° C. for 2 hours to thereby obtain a urea-modified polyester (U1) having a weight average molecular weight of 64,000.

In the same manner as stated above, bisphenol A-ethylene oxide 2 mol adduct (724 parts) and terephthalic acid (276 parts) were polycondensated at 230° C. at normal pressure for 8 hours. Next, they were reacted at reduced pressure of from 10 mmHg to 15 mmHg for 5 hours, to thereby obtain an unmodified polyester (E1) having a peak molecular weight of 5,000. The urea-modified polyester (U1) (200 parts) and the unmodified polyester (E1) (800 parts) were dissolved into an ethyl acetate/MEK (1/1) mixed solvent (2,000 parts), followed by mixing together to thereby obtain a solution of a binder resin (B1) in ethyl acetate/MEK.

The solution was partially dried at a reduced pressure to thereby isolate the binder resin (B1). The binder resin was found to have the Tg of 62° C.

(Polyester Resin Synthetic Example A)

| | |
|---|---|
| Terephthalic acid | 60 parts |
| Dodecenylsuccinic anhydride | 25 parts |
| Trimellitic anhydride | 15 parts |
| Bisphenol A (2,2) propylene oxide | 70 parts |
| Bisphenol A (2,2) ethylene oxide | 50 parts |

The above-described composition was placed in a 1-liter four-neck round bottom flask equipped with a thermometer, a stirrer, a condenser and a nitrogen gas introducing pipe. The flask was set in a mantle heater and heated while a nitrogen gas was introduced into the flask through the nitrogen gas introducing pipe so that the inside of the flask was kept under an inactive atmosphere. Then, 0.05 g of dibutyltin oxide was added thereto, the resultant mixture was heated at 200° C. to allow to react, to thereby obtain polyester A. The polyester A was found to have the peak molecular weight of 4,200 and the glass transition temperature of 59.4° C.

(Production Example of Master Batch 1)

| | |
|---|---|
| Pigment: C.I. Pigment Yellow 155 | 40 parts |
| Binder resin: Polyester resin A | 60 parts |
| Water | 30 parts |

The above-described materials were mixed together with HENSCHEL MIXER, to thereby obtain a mixture containing pigment aggregates impregnated with water. The resultant mixture was kneaded for 45 min with a two-roll mill of which roll surface temperature had been set to 130° C. The kneaded product was pulverized with a pulverizer so as to have a diameter of 1 mm, to thereby obtain a masterbatch (M1).

(Production Example of Toner 1)

A beaker was charged with 2,400 parts of the solution of the binder resin (B1) in ethyl acetate/MEK, 200 parts of pentaerythritol tetrabehenate (melting point: 81° C., melt viscosity: 25 cps), and 80 parts of the masterbatch (M1), and the mixture was stirred at 12,000 rpm by TK HOMOMIXER at 60° C., to uniformly dissolve and disperse the materials, to thereby prepare a toner material solution.

A separate beaker was charged with 7,060 parts of ion-exchanged water, 2,940 parts of a 10% by mass hydroxyapatite suspension (SUPERTITE 10, manufactured by Nippon Chemical Industrial Co., Ltd.), and 0.20 parts of sodium dodecyl benzene sulfonate, and the mixture was homogenously dissolved.

Then, the mixture was heated to 60° C., and the above-obtained toner material solution was added thereto with stirring at 12,000 rpm by TK HOMOMIXER, followed by stirring for 10 min.

Next, the resultant mixed solution was poured into a flask equipped with a stirring rod and a thermometer, and heated to 98° C. to remove the solvent, followed by being subjected to filtration, washing, drying, and air classification, to thereby obtain toner particles.

The toner particles (1,000 parts) were mixed with hydrophobic silica (1.00 part) and hydrophobic titanium oxide (1.00 part) by means of HENSCHEL MIXER, to thereby obtain a "toner 1".

The particle diameter of the "toner 1" was measured by a particle size analyzer (COULTER COUNTER TA-2, manufactured by Beckman Coulter, Inc.) using an aperture having a diameter of 100 μm, and was found to have a volume average particle diameter (Dv) of 6.2 μm and a number average particle diameter (Dn) of 5.1 μm.

The circularity of the "toner 1" was measured as the average circularity by a flow particle image analyzer (FPIA-1000, manufactured by SYSMEX Corp). Specifically, 100 mL to 150 mL of water from which solid impurities had been removed was poured into the analyzer, 0.1 mL to 0.5 mL of a surfactant (alkylbenzene sulfonate) serving as a dispersing agent and about 0.1 g to about 0.5 g of a measurement sample was further added therein. Next, the resultant was dispersed by an ultrasonic dispersion device for about 1 min to about 3 min to adjust the concentration of the resultant dispersion liquid to 3,000 particles/μL to 10,000 particles/μL. Then, the resultant dispersion liquid was measured for the circularity. The "toner 1" was found to have the average circularity of 0.96.

The replenishing developers used in Examples 2 to 11 and Comparative Example 1 were prepared in the same manner as the preparation of the replenishing developer used in Example 1, except that the type of core material, the type of filler, and the content of carrier described in the following Table 2 were used.

<Replenishing Developer Housing Container>

The replenishing developer housing container shown in FIG. 10 (having a cross-section shown in FIG. 30 at the container opening portion) was used. The container body was filled with each of the replenishing developers produced as above.

The container body of the replenishing developer housing container shown in FIG. 10 had a protruding portion protruding from the container body interior side of the container opening portion toward one end of the container body.

The uplifting portion had an uplifting wall surface extending from the internal wall surface of the container body toward the protruding portion, and a curving portion curving so as to conform to the protruding portion.

The uplifting portion also had a rising portion rising from the internal wall surface of the container body toward the protruding portion. The rising portion had the curving portion curving so as to conform to the protruding portion.

The protruding portion was provided such that when the replenishing developer housing container was mounted on a replenishing developer conveying device, the protruding portion was present between the curving portion and a replenishing developer receiving port of the conveying pipe being inserted.

Furthermore, in the replenishing developer housing container shown in FIG. 10, the protruding portion was a plate-shaped member, and provided such that a flat side surface of the plate-shaped member (i.e., the side surface thereof in the thickness direction) was present between the curving portion and the replenishing developer receiving port of the replenishing developer conveying pipe being inserted.

Moreover, the replenishing developer housing container shown in FIG. 10 had two uplifting portions that each had the uplifting wall surface. The two uplifting portions were provided such that when the replenishing developer housing container was mounted on the replenishing developer conveying device, the protruding portion was present between the curving portion of each uplifting portion and the replenishing developer receiving port of the conveying pipe being inserted.

In the replenishing developer housing container shown in FIG. 10, the uplifting portions were formed integrally with the container body, the protruding portion was fixed on the container body, and the uplifting portions were configured to uplift the replenishing developer from a lower side to an upper side along with the rotation of the container body.

<Evaluation>

<<Replenishing Stability>>

The replenishing developer housing container was evaluated in the following evaluation method.

The replenishing developer housing container was filled with 120 g of replenishing developer (the cubic capacity of the replenishing developer housing container was 1,200 mL). The replenishing developer housing container was shaken to stir the replenishing developer sufficiently. The replenishing developer housing container was mounted on the replenishing device including the conveying nozzle described in the embodiment (see FIG. 9). The replenishing developer housing container was rotated and the replenishing device was operated, to measure the amount of replenishing developer to be discharged from the replenishing device.

Condition: rotation speed of the replenishing developer housing container: 100 rpm Pitch of the conveying screw in the conveying nozzle of the replenishing device: 12.5 mm Outer diameter of the conveying screw: 10 mm Shaft diameter of the conveying screw: 4 mm Rotation speed of the conveying screw: 500 rpm In the evaluation method, a replenishing property of the replenishing developer from the container body was evaluated according to the following criteria. Results are shown in Table 2.

[Evaluation Criteria]

Figure 39:
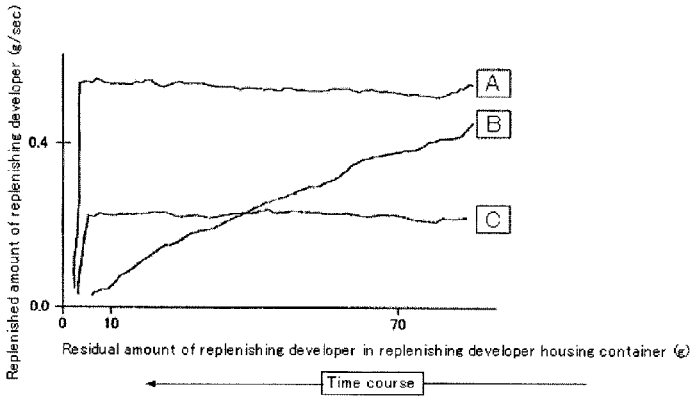
FIG. 39 is a graph showing a relationship between a residual amount of a replenishing developer in a replenishing developer housing container and a replenished amount of a replenishing developer.

A: Very good (when keeping on driving until the replenishing developer was no longer discharged, the replenished amount of the replenishing developer was maintained stably (at a constant level) in an amount of 0.4 g/sec or more in the range where the residual amount of the replenishing developer in the replenishing developer housing container was less than 70 g or 10 g or more. See, a line A in FIG. 39).

Note: The replenished amount of the replenishing developer of 0.4 g/sec is a replenished amount at which a solid image is expected not to blur due to a deficiency in replenished amount of the replenishing developer (solid followability) even when a full solid image is continuously fed on A4-sized sheets.

Note: In this experiment, assuming that the filled amount when not in use (filled amount of at the time of factory shipment) of the replenishing developer is 200 g or more, an amount of the replenishing developer was set to less than 70 g as described above in order to verify the discharging property. In view of an amount of a toner contained in the replenishing developer adhered to a container interior wall, the replenishing developer was set to 10 g or more.

B: Good (when keeping on driving until the replenishing developer was no longer discharged, the replenished amount of the replenishing developer was maintained at a constant level in an amount of less than 0.4 g/sec in the range where the residual amount of the replenishing developer in the replenishing developer housing container was less than 70 g or 10 g or more. See, a line B in FIG. 39).

Note: The replenished amount of the replenishing developer was less than 0.4 g/sec, but maintained stably (at a constant level). Therefore, the replenished amount of the replenishing developer can be raised by increasing the number of revolutions of the replenishing developer housing container, so that replenishment enough for solid followability can be stably achieved.

C: Acceptable (when keeping on driving until the replenishing developer was no longer discharged, the replenishing developer was discharged after the residual amount of the replenishing developer in the replenishing developer housing container reached less than 70 g, but the replenished amount thereof was not constant and slidingly decreased. See, a line C in FIG. 39).

Note: The replenishing developer is discharged, so that the replenished amount does not become zero. However, more complex replenishment control is required in order to ensure solid followability.

D: Unusable level in practice (when keeping on driving until the replenishing developer was no longer discharged, the replenishing developer was discharged once, but no longer discharged in a state in which the residual amount of the replenishing developer was 70 g or more).

E: Unusable level in practice (the replenishing developer was not discharged).

The above criteria A, B, and C were considered as accepted, and the above criteria D and E were considered as rejected.

Note: Here, the replenishing developers which were determined as A or B were drastically decreased (decreased with an inflection point) in the replenished amount in the range where the residual amount of the replenishing developer is less than 10 g.

Also, in this experiment, the replenished amount of the replenishing developers which were determined as A or B was varied in the range of 0.05 g/sec or less in the range where the residual amount of the replenishing developer is 10 g to 70 g.

TABLE 2

| | Content of carrier (%) | Type of core material | Type of filler | Discharging stability of toner |
|---|---|---|---|---|
| Example 1 | 10 | A | A | A |
| Example 2 | 10 | A | C | A |
| Example 3 | 10 | B | A | A |
| Example 4 | 10 | B | B | A |
| Example 5 | 10 | B | C | A |
| Example 6 | 10 | C | A | A |
| Example 7 | 10 | C | C | B |
| Example 8 | 1 | B | A | A |
| Example 9 | 3 | B | A | A |
| Example 10 | 20 | B | A | A |
| Example 11 | 50 | B | A | A |
| Comparative Example 1 | None | — | — | D |

Based on Examples and Comparative Example described above, it has been found that, according to the present invention, there can be provided a replenishing developer housing container that can replenish a developing device with a replenishing developer even when only a small amount of the replenishing developer remains in a replenishing developer housing container.

This application claims priority to Japanese application No. 2013-107437, filed on May 21, 2013 and incorporated herein by reference.

What is claimed is:

1. A replenishing developer housing container, comprising:

a container body mountable on a replenishing developer conveying device and housing a replenishing developer to be supplied into the replenishing developer conveying device;

a conveying portion provided in the container body and configured to convey the replenishing developer from one end of the container body in a longer direction thereof to an other end thereof at which a container opening portion is provided;

a pipe receiving port provided at the container opening portion and capable of receiving a conveying pipe fixed to the replenishing developer conveying device; and an uplifting portion configured to uplift the replenishing developer conveyed by the conveying portion from a lower side of the container body to an upper side thereof and move the replenishing developer into a replenishing developer receiving port of the conveying pipe, wherein the replenishing developer comprises a toner and a carrier, wherein the container body comprises a protruding portion protruding into a container body interior side of the container opening portion toward the one end, wherein the uplifting portion comprises an uplifting wall surface extending from an internal wall surface of the container body toward the protruding portion, and a curving portion curving in a shorter direction and in the longer direction so as to conform to the protruding portion, wherein the protruding portion is provided such that when the replenishing developer housing container is mounted on the replenishing developer conveying device, the protruding portion is present between the curving portion and the replenishing developer receiving port of the conveying pipe being inserted.

2. The replenishing developer housing container according to claim 1, wherein the replenishing developer contains the carrier in a percentage of 3% by mass to 50% by mass.

3. The replenishing developer housing container according to claim 1, wherein the carrier has a bulk density of 1.7 g/cm$^3$ to 2.6 g/cm$^3$.

4. The replenishing developer housing container according to claim 1, wherein the carrier comprises a coating layer containing particles, and wherein a ratio D/h of a volume average particle diameter D of the particles to an average thickness h of the coating layer is 0.01 to 1.00.

5. The replenishing developer housing container according to claim 4, wherein the particles have a powder specific resistance of −3 Log (Ω·cm) to 3 Log (Ω·cm).

6. The replenishing developer housing container according to claim 4, wherein the particles contain alumina, silica, titanium, barium, tin, carbon, or any combinations thereof.

7. The replenishing developer housing container according to claim 1, wherein the protruding portion is a plate-shaped member having a flat side surface, and wherein the flat side surface of the plate-shaped member is provided so as to be present between the curving portion and the replenishing developer receiving port of the conveying pipe being inserted.

8. The replenishing developer housing container according to claim 1, wherein the replenishing developer housing container comprises two uplifting portions, and wherein when the replenishing developer housing container is mounted on the replenishing developer conveying device, the protruding portion is present between the curving portions of respective ones of the two uplifting portions and the replenishing developer receiving port of the conveying pipe being inserted.

9. The replenishing developer housing container according to claim 1, wherein the uplifting portion and the protruding portion are fixed to the container body or formed integrally with the container body, and wherein the uplifting portion uplifts the replenishing developer from the lower side to the upper side by rotation of the container body.

10. The replenishing developer housing container according to claim 1, wherein the replenishing developer housing container comprises a shutter member capable of moving between a closing position to close the container opening portion to an opening position to open the container opening portion, wherein the shutter member moves from the closing position to the opening position by being pushed by the conveying pipe fixed to the replenishing developer conveying device, and wherein the protruding portion extends along a region in which the shutter member moves.

11. An image forming apparatus, comprising:

an image forming apparatus body in which the replenishing developer housing container according to claim 1 is set demountably.

12. A replenishing developer housing container, comprising:

a container body mountable on a replenishing developer conveying device and housing a replenishing developer to be supplied into the replenishing developer conveying device;

a conveying portion provided in the container body and configured to convey the replenishing developer from one end of the container body in a longer direction thereof to an other end thereof at which a container opening portion is provided;

a pipe receiving port provided at the container opening portion and capable of receiving a conveying pipe fixed to the replenishing developer conveying device; and an uplifting portion configured to uplift the replenishing developer conveyed by the conveying portion from a lower side of the container body to an upper side thereof and move the replenishing developer into a replenishing developer receiving port of the conveying pipe, wherein the replenishing developer comprises a toner and a carrier, wherein the container body comprises a protruding portion protruding into a container body interior side of the container opening portion toward the one end, wherein the uplifting portion comprises a rising portion rising from an internal wall surface of the container body toward the protruding portion, wherein the rising portion comprises a curving portion curving in a shorter direction and in the longer direction so as to conform to the protruding portion, wherein the protruding portion is provided such that when the replenishing developer housing container is mounted on the replenishing developer conveying device, the protruding portion is present between the curving portion and the replenishing developer receiving port of the conveying pipe being inserted.

13. The replenishing developer housing container according to claim 12, wherein the replenishing developer contains the carrier in a percentage of 3% by mass to 50% by mass.

14. The replenishing developer housing container according to claim 12, wherein the carrier has a bulk density of 1.7 $g/cm^3$ to 2.6 $g/cm^3$.

15. The replenishing developer housing container according to claim 12, wherein the carrier comprises a coating layer containing particles, and wherein a ratio D/h of a volume average particle diameter D of the particles to an average thickness h of the coating layer is 0.01 to 1.00.

16. The replenishing developer housing container according to claim 12, wherein the protruding portion is a plate-shaped member having a flat side surface, and wherein the flat side surface of the plate-shaped member is provided so as to be present between the curving portion and the replenishing developer receiving port of the conveying pipe being inserted.

17. The replenishing developer housing container according to claim 12, wherein the replenishing developer housing container comprises two uplifting portions, and wherein when the replenishing developer housing container is mounted on the replenishing developer conveying device, the protruding portion is present between the curving portions of respective ones of the two uplifting portions and the replenishing developer receiving port of the conveying pipe being inserted.

18. The replenishing developer housing container according to claim 12, wherein the uplifting portion and the protruding portion are fixed to the container body or formed integrally with the container body, and wherein the uplifting portion uplifts the replenishing developer from the lower side to the upper side by rotation of the container body.

19. The replenishing developer housing container according to claim 12, wherein the replenishing developer housing container comprises a shutter member capable of moving between a closing position to close the container opening portion to an opening position to open the container opening portion, wherein the shutter member moves from the closing position to the opening position by being pushed by the conveying pipe fixed to the replenishing developer conveying device, and wherein the protruding portion extends along a region in which the shutter member moves.

20. An image forming apparatus, comprising:

an image forming apparatus body in which the replenishing developer housing container according to claim 12 is set demountably.

* * * * *